US008443970B2

(12) United States Patent
Coon

(10) Patent No.: US 8,443,970 B2
(45) Date of Patent: May 21, 2013

(54) DISPENSING CAPSULE

(75) Inventor: Darren Coon, Brockport, NY (US)

(73) Assignee: Karma Culture, LLC, Mendon, NY (US)

( * ) Notice: Subject to any disclaimer, the term of this patent is extended or adjusted under 35 U.S.C. 154(b) by 119 days.

(21) Appl. No.: 12/766,868

(22) Filed: Apr. 24, 2010

(65) Prior Publication Data

US 2011/0174642 A1 Jul. 21, 2011

Related U.S. Application Data

(60) Provisional application No. 61/296,283, filed on Jan. 19, 2010.

(51) Int. Cl.
*B65D 25/08* (2006.01)
*B65D 1/00* (2006.01)

(52) U.S. Cl.
USPC ..... 206/222; 206/219; 222/83; 222/80

(58) Field of Classification Search
USPC ..... 206/0.5, 219, 220, 221, 222; 215/227, 215/228, 301; 220/227, 258.4, 780, 783, 220/796, 797; 222/494, 80, 81, 83
See application file for complete search history.

(56) References Cited

U.S. PATENT DOCUMENTS 2,387,978 A * 10/1945 Casey ..... 215/253
2,631,521 A 3/1953 Atkins, Jr.
3,156,369 A * 11/1964 Bowes et al. ..... 206/222
3,406,872 A 10/1968 Fiquet
3,970,068 A 7/1976 Sato
4,103,772 A 8/1978 Wiegner
4,174,035 A 11/1979 Wiegner
4,221,291 A 9/1980 Hunt
4,340,147 A 7/1982 McIntosh (Continued)

FOREIGN PATENT DOCUMENTS

GB 2456059 8/2009
JP 2010-510137 4/2010

(Continued)

OTHER PUBLICATIONS

Anton Steeman, More Bottle Caps for Sensitive Vitamins, webpage, Jun. 6, 2009, 4 pages, http://www.amsteeman.com/?p=1770.

*Primary Examiner* — J. Gregory Pickett
*Assistant Examiner* — Kaushikkumar Desai
(74) *Attorney, Agent, or Firm* — Woods Oviatt Gilman LLP; Katherine H. McGuire, Esq.

(57) ABSTRACT

A dispensing capsule has a diaphragm button, stake and frangible membrane for a system for selectively dispersing the contents of a cup into an attached bottle. A frangible membraned cup has a diaphragm button operably attached to a stake with the stake's sharp point at one end and the diaphragm button on the opposing end. A cavity is disposed in the cup for consumable product defined by side walls and a base plate. Preloaded ingredients contained within the hermetically sealed cup are discharged from the dispensing capsule into a bottle by simply depressing a button disposed on the diaphragm of the cup, thereby actuating the stake to thrust forward and apply concentrated pressure abaxially to the frangible membrane. This concentrated pressure pierces substantially the center of the frangible membrane, causing it to rupture and progressively opening it. The diaphragm button locks in this downward position, holding the stake into the opened frangible membrane to maintain the opening, permitting the contents to flow through the frangible membrane and exit the cavity of the cup.

27 Claims, 21 Drawing Sheets

U.S. PATENT DOCUMENTS

| | | | | |
|---|---|---|---|---|
| 4,757,916 | A * | 7/1988 | Goncalves | 222/83 |
| 4,770,305 | A | 9/1988 | Su et al. | |
| 5,025,942 | A * | 6/1991 | Lucas | 215/318 |
| 5,058,770 | A | 10/1991 | Herold et al. | |
| 5,080,259 | A | 1/1992 | Hadley | |
| 5,255,812 | A | 10/1993 | Hsu | |
| 5,626,022 | A | 5/1997 | Scudder et al. | |
| 5,772,017 | A | 6/1998 | Kang | |
| 5,809,786 | A | 9/1998 | Scudder et al. | |
| 5,979,164 | A | 11/1999 | Scudder et al. | |
| 6,003,728 | A | 12/1999 | Elliott | |
| 6,045,004 | A | 4/2000 | Elliott | |
| 6,056,142 | A | 5/2000 | Elliott | |
| 6,098,795 | A | 8/2000 | Mollstam et al. | |
| 6,230,884 | B1 * | 5/2001 | Coory | 206/222 |
| 6,266,879 | B1 | 7/2001 | Scudder et al. | |
| 6,305,576 | B1 | 10/2001 | Leoncavallo | |
| 6,338,252 | B1 | 1/2002 | Calderaio | |
| 6,357,627 | B1 | 3/2002 | Pasbrig et al. | |
| 6,364,163 | B1 | 4/2002 | Mueller | |
| 6,443,307 | B1 | 9/2002 | Burridge | |
| 6,474,506 | B2 | 11/2002 | Mawby et al. | |
| 6,488,428 | B1 | 12/2002 | Fischer | |
| 6,513,650 | B2 | 2/2003 | Mollstam | |
| 6,533,113 | B2 | 3/2003 | Moscovitz | |
| 6,769,539 | B2 | 8/2004 | Stern | |
| 6,786,330 | B2 | 9/2004 | Mollstam et al. | |
| 6,840,373 | B2 * | 1/2005 | Gibler et al. | 206/219 |
| 6,880,550 | B2 | 4/2005 | Miller et al. | |
| 6,908,011 | B2 | 6/2005 | Cho | |
| 6,935,493 | B2 * | 8/2005 | Cho | 206/222 |
| 6,986,345 | B2 | 1/2006 | Kolb | |
| 7,004,161 | B2 | 2/2006 | Kolb | |
| 7,017,735 | B2 | 3/2006 | Carlson | |
| 7,175,049 | B2 | 2/2007 | Kastenschmidt | |
| 7,279,187 | B2 | 10/2007 | Daniels | |
| 7,549,558 | B2 | 6/2009 | Weist | |
| 7,578,386 | B2 | 8/2009 | Im | |
| 7,607,549 | B2 | 10/2009 | Morini | |
| 7,607,555 | B2 | 10/2009 | Smith | |
| 2002/0066677 | A1 | 6/2002 | Moscovitz | |
| 2002/0157970 | A1 * | 10/2002 | Carlson | 206/222 |
| 2003/0213709 | A1 | 11/2003 | Gibler | |
| 2004/0104247 | A1 | 6/2004 | Anderson | |
| 2005/0198969 | A1 | 9/2005 | Scudder et al. | |
| 2007/0090000 | A1 | 4/2007 | Hjalmarsson | |
| 2008/0179331 | A1 * | 7/2008 | Sharp | 220/521 |
| 2009/0199843 | A1 | 8/2009 | Farone et al. | |
| 2009/0236244 | A1 | 9/2009 | Frutin | |
| 2009/0242561 | A1 | 10/2009 | Wellman | |
| 2010/0012660 | A1 | 1/2010 | Morini et al. | |

FOREIGN PATENT DOCUMENTS

| | | |
|---|---|---|
| WO | WO9317928 | 9/1993 |
| WO | WO0053507 | 9/2000 |
| WO | WO0105674 | 1/2001 |
| WO | WO0124672 | 4/2001 |
| WO | WO02092440 | 11/2002 |
| WO | WO03036186 | 5/2003 |
| WO | WO2005012133 | 2/2005 |
| WO | WO2009052521 | 4/2009 |

* cited by examiner

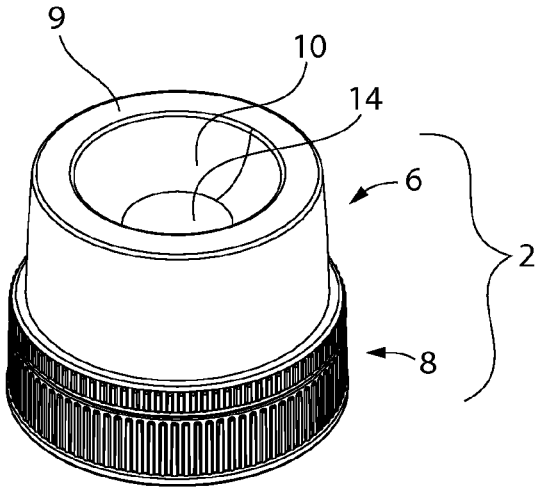
FIG. 9
FIG. 10
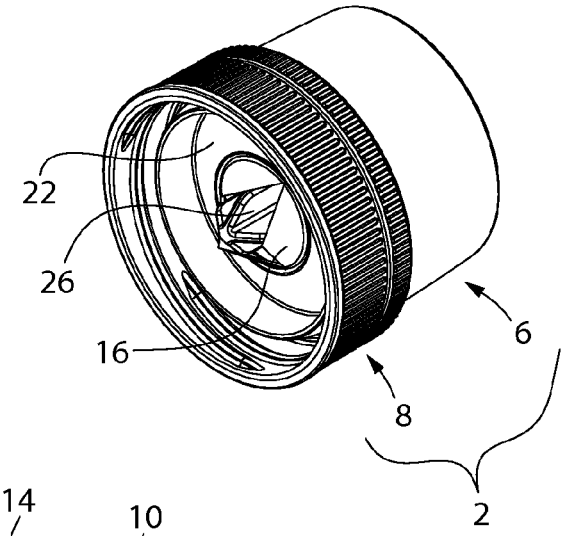
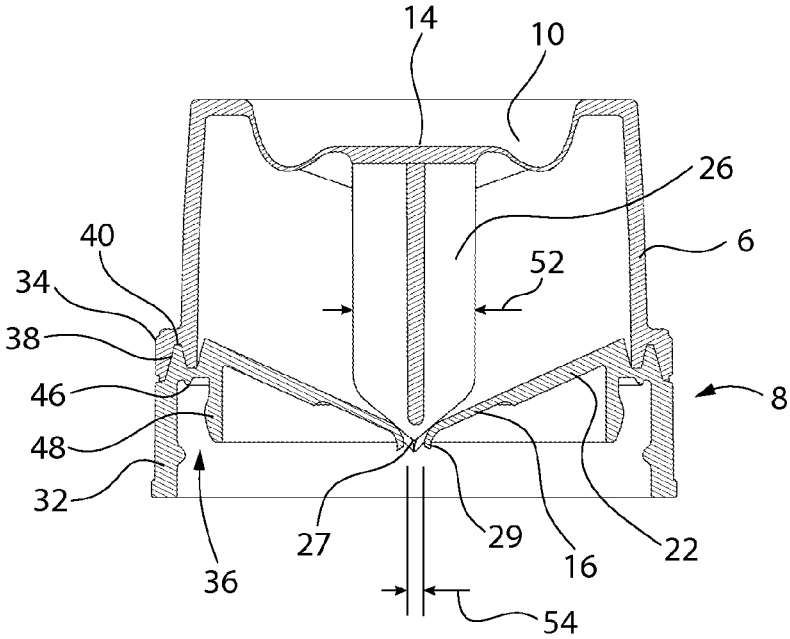
FIG. 11

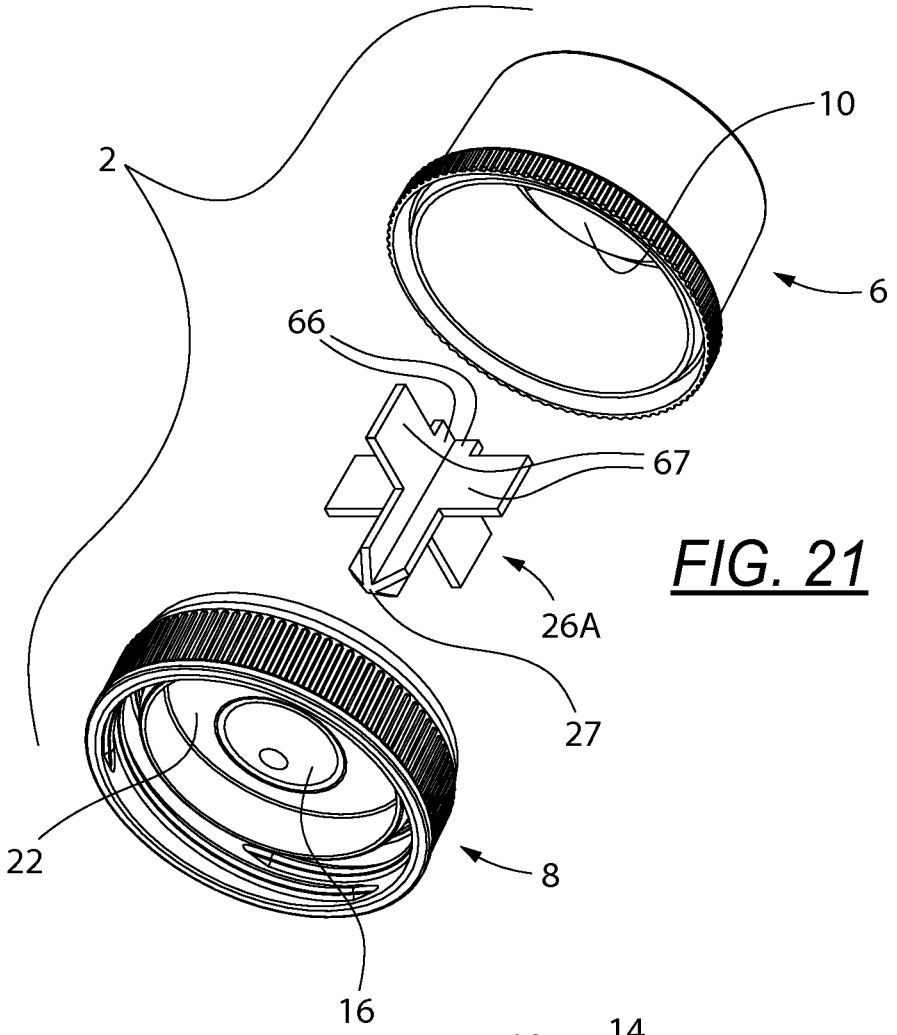
FIG. 21
FIG. 22
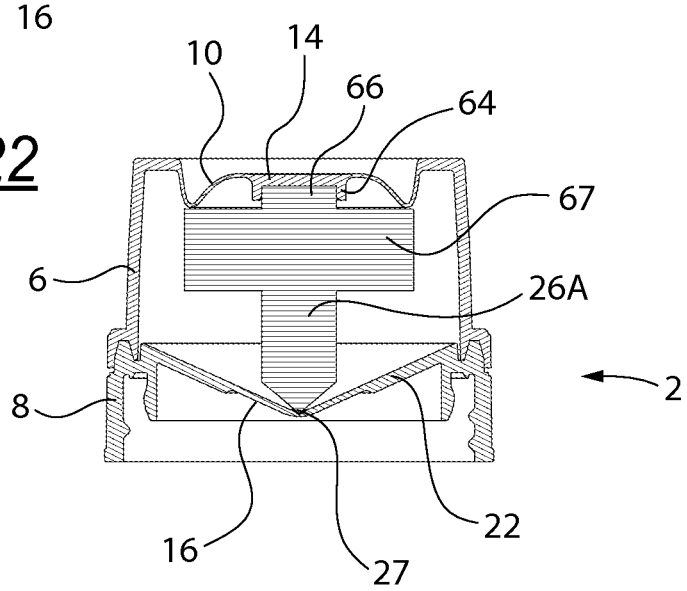

DISPENSING CAPSULE

PRIORITY AND RELATED APPLICATIONS

This application claims the benefit of priority from provisional application U.S. Ser. No. 61/296,283 filed Jan. 19, 2010 entitled "Bottle Top Dispensing Capsule". The disclosure of said application is incorporated by reference herein in its entirety.

FIELD OF THE INVENTION

The present device relates generally to dispensing capsules, and more specifically, to a dispensing capsule for removable engagement with a liquid-containing bottle and enabling dry or liquid ingredients contained within the dispensing capsule to be conveniently deposited into a bottle and mixed with the liquid contents thereof.

BACKGROUND OF THE INVENTION

Many products are sold as liquid concentrates, crystals and powders to be mixed with a liquid prior to consumption or use. Such products include foods, drugs, cosmetics, adhesives, polishes, cleansers, dyes, infant formula, drink mixes, meal replacements, protein powders, energy mixes, supplements, nutritional products and other substances. Some of these products do not retain their stability, strength and effectiveness for long after they have been mixed in solution or suspension, yet the product can be stored for extended periods of time if one ingredient is maintained separate from the other. This necessarily requires that the product be utilized relatively soon after mixing to prevent deterioration, spoilage, interactions and the like. Well known illustrative examples include epoxy adhesives, infant formula and enzyme enriched nutritional products.

Simultaneously, the active on-the-go lifestyle has also fueled the demand for portable, disposable and convenient product delivery packaging that delivers a premeasured amount of one ingredient for mixing with a measured amount of a liquid to insure that the desired solution concentration is obtained. Manufacturers are presented with a number of challenges in merchandising of products of this genre. In order to supply two companion products to the consumer in a single package, it obviously is desirable that both ingredients be sold as part of the same package such that a single package can be utilized for maintaining such compounds separated.

Consumers are also presented a number of challenges in using these products. Consumers often purchase large containers or bulk quantities of infant formulas, drink mixes, meal supplement or nutritional powders. A small single serving portion of such powder or drink mix must be combined with water or other suitable liquids for consumption. However, the inconveniences associated with the use of such large containers of powders or mixes is well known. Consumers must undertake the time-consuming and often messy process of properly combining and mixing the powder with a container of liquid, measuring and depositing the appropriate amount of liquid or powder within the container and, thereafter, shake, stir or otherwise fully mix the combined contents. In doing so, powder and/or powder-liquid mix often spills, resulting in mess and partial loss of product.

To address these challenges, containers have been designed with two compartments in which two ingredients may be stored separately until it is desired to mix them, at which time it is possible to establish communication between the compartments so that the separated ingredients may move from one compartment to the other. It is known in the art to provide dispensers containing a concentrate of soluble materials to a fixed quantity of solute, usually water, for dispensing. Generally, the interior of the container is divided into a compartment having a liquid and a compartment which can be selectively ruptured by a user so as to mix the separately stored liquid or powder material on demand.

There are several drawbacks and limitations with the prior art containers of this type and design. Prior art containers are generally manufactured of a plurality of separate components. These multiple component designs are more expensive to manufacture and offer a less reliable seal that is subject to mechanical failure under pressure or temperature changes that accompany transportation and long term storage of the end product. Some designs experience capillary action that leaks the dispenser's contents into the liquid in an attached bottle. Thus, the seal is not a hermetic one and the contents are subject to spoilage or contamination prior to use (consumption). One dispensing cap that can be selectively attached to a bottle is disclosed in U.S. Ser. No. 12/368,087 ('087) invented and commonly owned by Applicant. This dispensing cap overcomes many of the prior art problems, however, the mechanism is not ideal for all applications. The plunger on the '087 dispensing cap is a separate component welded on to a diaphragm button. If the weld was defective, this small plunger could detach and end up in the drink, causing a choking hazard.

In some applications, a diaphragm actuated stake type design that applies pressure to rupture the tear lines of a plastic sealing means is preferable. This stake-type configuration can offer more durable seals that withstand higher pressures from the attached bottle and the cap's own interior due to temperature, loading, carbon dioxide, handling, ambient pressure changes and agitation. Additionally the manufacturing method for production of this configuration is sometimes preferable, specifically, the method of sealing the contents in the dispensing cap.

U.S. Pat. No. 6,045,004 discloses a dispensing cap such as those commonly used on a bottle of ketchup and has such a stake type design. However, this device does not store and release material. U.S. Pat. Nos. 7,004,161 and 5,255,812 disclose a stake and diaphragm button mechanism which ruptures a membrane (flat thin film). However, this frangible membrane has drawbacks. The frangible membrane is inherently more delicate and may not hold up to environmental conditions typically encountered by drink bottles. Moreover, these designs do not promote material flow from the cap into the liquid in an attached bottle. Additionally, parts of the membrane could detach and end up in the consumable product.

Thus, it is desirable to provide a diaphragm actuated stake style dispensing capsule that may be selectively and detachably mounted on a liquid-containing bottle or container enabling dry or liquid ingredients contained within the dispensing capsule to be conveniently deposited into the container and mixed with the liquid contents thereof that has none of the drawbacks or limitations of the prior art.

SUMMARY OF INVENTION

The present device overcomes the shortcomings of the prior art by providing one or more structures and methods for selectively securing and detachably mounting a dispensing capsule to a liquid containing bottle or container. Briefly described, in a preferred embodiment, the present dispensing capsule overcomes the above-mentioned prior art disadvantages, and meets the recognized need for such a device by providing a dispensing capsule ("dispensing capsule") and method for use thereof, wherein the dispensing capsule is preferably pre-loaded during time of manufacture with a selected dry or liquid ingredient to facilitate subsequent consumer use.

The novel dispensing capsule comprises two components jointed together during the manufacturing process: a cup and a base. When assembled for use, the base plate of the base forms a wall to close the cavity on the interior of the cup and seal in the contents. The cup is formed integrally with a diaphragm button operably attached to a stake at the stake's base. The diaphragm button, stake and base plate form a novel and more durable, less pressure sensitive system for selectively dispersing the contents of the cup into an attached bottle. The stake's sharp point is at one end and the diaphragm button on the opposing end. A cavity is disposed in the cup for consumable product defined by side walls and the base plate of the base. A cone shaped surface is alternatively formed at the stake's base with the cone base concentrically disposed on the stake's base inside the cavity. Preloaded ingredients contained within the hermetically sealed cup may be introduced or discharged from the dispensing capsule and/or into a liquid containing receiving container (e.g., bottle) by simply depressing a button disposed on the diaphragm of the cup, thereby actuating the stake to thrust forward and apply concentrated stress abaxially to the base plate and flex the base plate downwardly and outwardly. This concentrated stress causes the base plate to rupture at the tear lines, forming an aperture which is progressively enlarged as the stake is driven downwardly. The diaphragm button locks in this downward position, holding the stake into the opened aperture to maintain the opening, permitting the contents to flow through the aperture and exit the cavity of the cup. The combined contents and liquid within the receiving container may subsequently be agitated (e.g., shaken or mixed) without fear or risk of leakage or spillage.

The cup is preferably pre-loaded during time of manufacture with a selected dry or liquid ingredient to facilitate subsequent consumer use; however, it is also contemplated that the cavity may be loaded with a selected ingredient at the time of initial consumer use (i.e., post-manufacture). In this aspect, the dispensing capsule may be either disposable or reusable. The present dispensing capsule is preferably removably engageable to the mouth of a conventional personal-sized water bottle or other liquid-containing bottle; however, it should be recognized that the technology of the present device may be appropriately modified to accommodate the various structural properties of a selected liquid containing container, including, without limitation, mouth diameter, flanged mouths, threaded or unthreaded mouths, and/or the like. The cup may also be configured as a hand held device.

The cup may be integrally packaged as a sealed unit comprising the dispensing capsule and bottle/container. Both the bottle and the dispensing capsule are preferably pre-loaded during time of manufacture with a selected ingredients; however, it is also contemplated that either or both the dispensing unit and bottle may be loaded with a selected ingredient at the time of initial consumer use (i.e., post-manufacture).

The cup preferably comprises a diaphragm functioning as a top wall in communication with a cylindrical-shaped sidewall. A base plate is located on the base correspondingly in communication with the cylindrical-shaped sidewall when the cup-base unit is assembled or jointed together. The base plate is conical shaped to promote the flow of the cap contents through the aperture and into the attached bottle. The base plate is concentrically but opposingly disposed from a button. The tear lines are concentrically disposed on the base plate. The button and stake are coaxially aligned and operably connected to one another. In use, the stake extends through an aperture made in the base plate.

Slideable movement of the cup with respect to the mouth of the bottle is preferably restricted via a mounting flange externally disposed, preferably at the bottom of the cup (that is, the end opposing the diaphragm button). The general mounting flange arrangement of the dispensing capsule further provides an effective sealing means during use of the present device. A weld interference facilitates the juncture between the cup and a base, sealing the two with friction fit. The weld interference is the area where plastic from the cap and cup melt and flow together to form the weld. The base, and in particular its internal threading, facilitates the connection between the cup-base unit and the attached bottle.

The base has a bore seal that cooperates with the base plate, internal threading and a wedge seal to effectively seal the liquid in the attached bottle. The bore seal is optional and may be eliminated in certain embodiments. Ribbing is provided on the exterior peripheral surface of the cup and base to increase friction for gripping the cap during its installation and removal from a bottle. In some aspects, a drop band is provided along the bottom edge of the base to function as a tamper evident seal.

When the dispensing capsule is in a "closed position", the preloaded ingredients or contents are maintained within the cavity (e.g. storage receptacle) of the cup by virtue of the base plate of the capsule functioning as an effective seal between the storage receptacle and fluid compartment of the bottle or ambient environment surrounding the dispensing capsule.

When in the open position, the cavity of the cup is in fluid communication with the fluid compartment of the bottle. To place the dispensing capsule into an "open position", so that the contents of the cavity of the cup may be introduced or discharged into the communicating bottle or air, the button on the diaphragm is sufficiently depressed or forcefully pushed to downwardly thrust the stake toward the center in the base plate causing an aperture to form at the center of the base plate and a predictable tear pattern substantially in accordance with the pattern of the tear lines in the aperture and the stake is introduced into the fluid cavity; thus, enabling the contents thereof to flow through the aperture of the base plate and into the liquid contents of the bottle or air. The combined ingredients and liquid within the bottle may subsequently be agitated (shaken) without fear or risk of leakage or spillage. Following the shaking process, consumption of the fully mixed solution may be had by the user. For sake of clarity, the activation is described in terms of pushing downwardly, however, it is to be appreciated that other configurations and directions are contemplated and considered within the spirit and scope of the present device. As will be apparent to one skilled in the art, the direction of force will align with the stake axis.

Accordingly, a feature and advantage of the present device is its ability to facilitate the introduction of a dry/liquid ingredient into a bottle, without risk of spillage of the ingredient.

Still another feature and advantage of the present device is its ability to provide a preloaded mixing cap or dispensing capsule.

Still another feature and advantage of the present device is its ability to provide a bottle or containers having two compartments in which two ingredients (one of which is a liquid) may be stored separately until it is desired to mix them, at which time it is possible to establish communication between the compartments so that the separated ingredients may move from one compartment to the other.

Still yet another feature and advantage of the present device is its ability to provide a dispensing capsule, the contents of which may be introduced or discharged into a bottle or the air by simply depressing the diaphragm of the dispensing capsule.

It is yet another object of the present device to provide a portable dispensing capsule that may be mounted to fluid containing containers and bottles of varying sizes and configurations.

Still yet another feature and advantage of the present device is its ability to provide a dispensing capsule that eliminates or minimizes obstruction in the material dispensing path due to partially detached breakaway flaps.

Still yet another feature and advantage of the present device is its ability to provide a dispensing capsule that fully disperses its contents into the fluid cavity of a receiving container.

Still yet another feature and advantage of the present device is its ability to provide a dispensing capsule that predictably distributes an activating force across the tear lines and aperture.

Still yet another feature and advantage of the present device is its ability to provide a dispensing capsule that eliminates or minimizes a mechanical failure of a seal on a breakaway dispenser due to pressure differences between the dispenser's interior and exterior.

Still yet another feature and advantage of the present device is its ability to provide a dispensing capsule that facilitates uniform mixing of its consumable contents with a fluid in the receiving container.

Still yet another feature and advantage of the present device is its ability to provide a dispensing capsule having a barrier for materials separation whose break pattern is predictable.

It is yet another object of this device to provide a dispensing capsule that is relatively economical from the viewpoint of the manufacturer and consumer, is susceptible to low manufacturing costs with regard to labor and materials, and which accordingly is then susceptible of low prices for the consuming public, thereby making it economically available to the buying public.

It is yet another object of this invention to provide a relatively simple device that is economical for mass production from the viewpoint of the manufacturer and consumer, thereby making it economically available to the buying public.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

Particular Advantages of the Invention

Partially detached breakaway flaps obstruct the dispersion path of the dispensing capsule's contents. The present device provides a dispersion capsule with a stake that is injection molded with and thus integrally part of the diaphragm button such that it does not fall into the fluid cavity after an aperture allowing fluid communication between the capsule's contents and the fluid cavity has been opened. This provides the additional advantage that loose non-consumable material from the opening operation is not introduced into the consumable solution. Obstruction is further minimized by the present device by providing a conically shaped base plate such that the inclined surface urges full dispersion of the contents into the fluid cavity of a receiving container.

Prior art dispensing caps fully or partially conceal the contents from the user or potential consumer, especially with a double side wall structure. In the present invention, the single wall cup functions to prominently display its contents above the attached bottle. By eliminating a dual side wall structure, the contents are more visible to a user for easy identification.

Stress concentrators advantageously provide a means of predictably transmit an axially applied force to the stake to selected portions of the base plate and tear lines such a relatively large force is predictably applied over a small specific portions of the base plate. A predictable break pattern is provided by a stake having stress concentrating ribs with varying stiffness and/or geometry such that when the diaphragm button is activated, the stress concentrating ribs of the stake cause the aperture to tear along tear lines according to the magnitude of force exerted by each stress concentrating rib. By providing more stress concentrating ribs than tear lines, the aperture is fully opened at a faster rate and with higher reliability.

The base plate is formed of a thin polymer plate and is thicker and more durable than a typical thin film membrane. Its mechanism of rupture relies on the stake mechanism rather than the fragility of the plate. This durable base plate and flexible diaphragm allow the dispensing capsule to withstand high gauge pressure differential between the fluid cavity and the capsule cavity of over 14 psi (9.653 e+004 newtons/square meter) and to withstand the rigors of transportation, handling and storage that often cause aperture trauma.

The dispensing capsule is formed by two easily jointed components, a cup and a base, that can be spin welded, providing several advantages over ultrasonic welding: lower power consumption, higher strength hermetic weld, more reliable welding of polypropylene and polyethylene. This ease of jointing the cup and base components during the pre-filling process simplifies the manufacturing process.

While prior art dispensing caps use a flat membrane that is ruptured by a stake, such a ruptured membrane is not conducive to material flow down and out of the dispenser, causing mixing problems and problems with residual material in the dispenser when the dispenser, affixed to a drinking bottle, is removed for drinking (material dripping from cap). The dispensing capsule provides an inclined base plate and aperture to funnel material (powder, water mixture) out of the capsule. Furthermore, an inclined (cone shaped) surface is provided at the stake's base such that capsule material contacting the interior surface of the diaphragm button is pushed sideways, away from the stake to facilitate movement of the stake towards the plate.

BRIEF DESCRIPTION OF THE DRAWINGS

The invention will be described by reference to the specification and the drawings, in which like numerals refer to like elements, and wherein:

FIG. 9 is a top perspective view of a dispensing capsule with a diaphragm button depressed.

FIG. 10 is a bottom perspective bottom view of a dispensing capsule with the base plate penetrated and opened by the stake.

FIG. 11 is a front orthogonal sectional view of a first stage of a dispensing capsule depicting the stake rupturing the base plate center.

FIG. 21 is an exploded bottom perspective view of an alternate embodiment of a dispensing cap where the stake is not integral with the diaphragm.

FIG. 22 is a front orthogonal sectional view of the assembled dispensing capsule depicted in FIG. 21.

Figure 1:
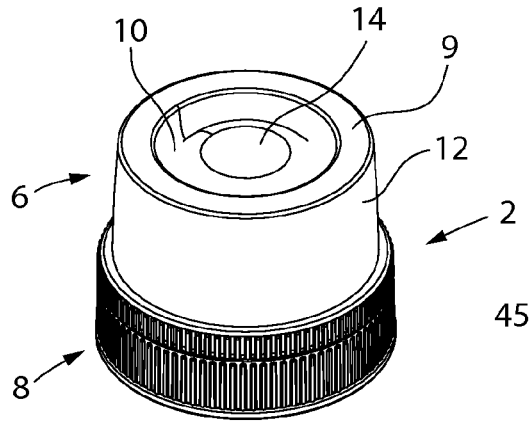
FIG. 1 is a top front perspective view of an assembled dispensing capsule.

The drawings are not to scale, in fact, some aspects have been emphasized for a better illustration and understanding of the written description.

PARTS LIST

2 dispensing capsule
4 receiving container

6 cup of dispensing capsule
8 base of dispensing capsule
9 shoulder of cup
10 diaphragm
11 diaphragm
12 cylindrical side wall of cup
14 diaphragm button
16 frangible portion of base plate
17 flat frangible portion of base plate
18 liquid contained in receiving container
20 contents of dispensing capsule
22 base plate of base
24 cavity of dispensing capsule
26 stake
26A nonintegral stake
27 tip of stake
28 base plate's tear lines
28A tear line
28B tear line
29 opening formed in frangible membrane 16
32 base mounting flange
34 cup mounting flange
36 container receptacle of base mounting flange
38 seal edge of base mounting flange
39 groove in the base's seal edge
40 seal edge of cup mounting flange
41 tongue in the cup's seal edge
42 exterior peripheral surface of base mounting flange
44 exterior peripheral surface of cup mounting flange
45 internal threading on container receptacle
46 wedge seal of container receptacle of base mounting flange
48 bore seal of container receptacle of base mounting flange
50 stress concentrating ribs
51 short rib
52 larger diameter portion of stake
53 narrow rib
54 smaller diameter portion of stake
55 pointed end
56 label
57 narrow rib
58 pull tab
59 fold
60 sticker style tamper evident seal
61 fold
62 drop band
64 receiving detent of stake 26A
66 connection portion of stake 26A
67 securing portion of stake 26A
68 increased diameter stress concentrating ribs of stake 26A
69 cardboard layer
70 external load exerted on stacked dispensing capsules
71 seal edge of flangeless cup
72 syringe style dispensing capsule
73 seal edge of flangeless base
74 protruding lip of syringe style dispensing capsule
75 flangeless dispensing capsule
76 diaphragm button of syringe style dispensing capsule
77 screw threaded mouth of container
78 cavity of syringe style dispensing capsule
79 screw threaded mounting flange
80 base of syringe style dispensing capsule
82 base plate of syringe style dispensing capsule
84 frangible portion of syringe style dispensing capsule
102 dispensing capsule
106 cup of dispensing capsule
108 base of dispensing capsule
110 diaphragm
112 cylindrical side wall of base
114 diaphragm button
116 cavity of dispensing capsule 102
122 base plate of base
132 base mounting flange
134 top mounting flange
136 container receptacle of base mounting flange
138 cone shaped stake base
140 cylindrical diaphragm button

DETAILED DESCRIPTION OF A PREFERRED EMBODIMENT

The use of conventional liquid containers such as plastic bottles for carrying water, juices, and other desirable liquids for human consumption is quite well known. The present device is generally directed, although not so limited, to a dispensing capsule that may be used with such bottles or containers to separately store an ingredient to be mixed with a liquid at the time of consumption to form a consumable solution or suspension. The dispensing capsule may also be used with other types of receiving containers where separate storage of one ingredient for mixing with a liquid at the time of use is desirable. In describing the preferred and alternate embodiments of the present device, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

Figure 2:
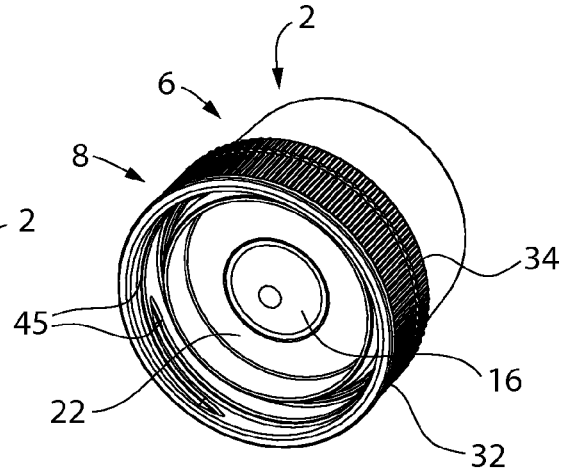
FIG. 2 is a bottom perspective view of an assembled dispensing capsule.

FIGS. 1 and 2 are a top front perspective view and a bottom perspective view, respectively, of an assembled dispensing capsule 2. The dispensing capsule 2 comprises a cup 6 and a base 8 jointed together, preferably by a plastic weld. The cup 6 comprises a circular top wall, a shoulder 9 disposed at the periphery of the circular top wall slightly protruding above the plane of the circular top wall and a cylindrical side wall 12 extending downwardly therefrom. In the embodiment shown, the circular top wall of the cup 6 is a diaphragm 10 that may be integrally formed with the shoulder and cylindrical side wall 12 or a separate component that may be affixed thereto. It is contemplated that the cup 6 and its cavity 24 may be manufactured in any selected volumetric size so as to provide a variety of preloaded dispensing capsules 2 adapted to facilitate the ingestion or consumption of accurately measured quantities of consumable product. FIG. 2 reveals a bottom perspective view of the base 8 showing a base plate 22 and a concentrically disposed frangible portion 16.

Referring to FIGS. 1 and 2, the exterior peripheral surface of the cup mounting flange 34 and the exterior peripheral surface of the base's mounting flange 32 have ribbing or other textured surface features. This ribbing provides a grip surface that allows for easy gripping and twisting of the dispensing cap 2 during its functional use as a bottle cap.

Figure 3:
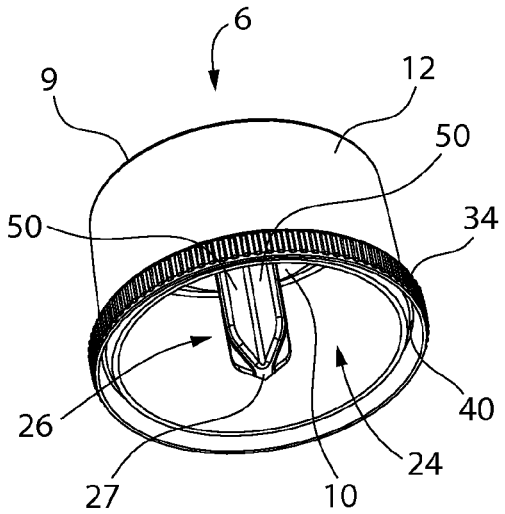
FIG. 3 is a bottom perspective view of a cup.

FIG. 3 is a bottom perspective view of a dispensing capsule in its unassembled form showing a cup 6. The cup 6 comprises a diaphragm 10, a shoulder 9, a cylindrical side wall 12 extending substantially downwardly at right angle therefrom, a mounting flange 34, a seal edge 40 disposed on the bottom periphery of the mounting flange 34, a stake 26 fixedly attached on one end at its base to the diaphragm 10 and a cavity 24 generally defined by the sidewall 12 and diaphragm 10. The stake 26 has a tip 27 opposingly disposed from the diaphragm 10. In this embodiment, the stake 26 comprises four longitudinal equiangularly disposed stress concentrating ribs starting from the end attached to the diaphragm 10 at substantially constant height and terminating at the tip 27 at substantially reduced height to form a sharp point. As well known in the art, the shape (geometry), thickness and dimensions of each part of the stake determine the stiffness of the stake.

Figure 4:
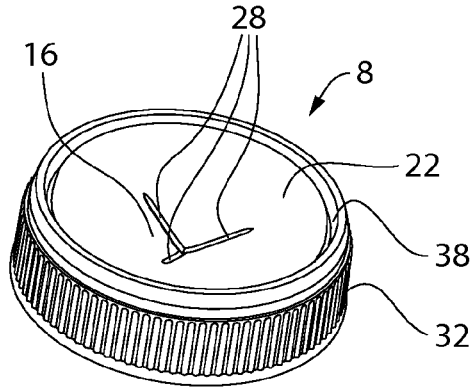
FIG. 4 is a top perspective view of a base.
Figure 5:
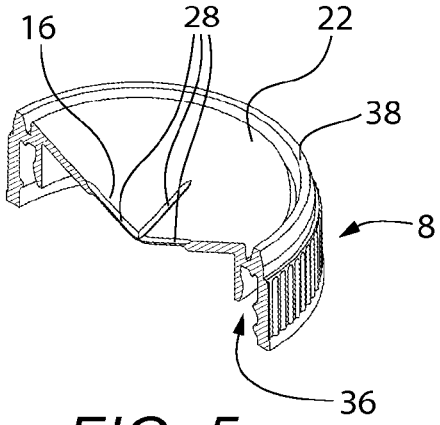
FIG. 5 is a top partial perspective sectional view of a base.

FIG. 4 is a top perspective view of a dispensing capsule in its unassembled form showing a base 8 and FIG. 5 is a sectional view of the base shown in FIG. 4. The base 8 has a base plate 22, a base mounting flange 32 disposed along the periphery of the base plate 22, generally extending perpendicularly thereto, a frangible portion 16 centrically disposed on the base plate 22, a plurality of tear lines 28 forming a pattern of three substantially rectilinear equiangular tear lines that is centrically disposed on the frangible portion 16, a seal edge 38 disposed along the top periphery of the base 8 and a container receptacle 36 for receiving a container along the bottom periphery of the base mounting flange 32. The cutaway portion of FIG. 5 clearly shows a base plate 22 that is generally conically shaped with its apex pointing downwards.

Figure 6:
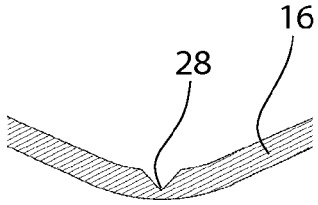
FIG. 6 is a front partial orthogonal sectional view of one embodiment of a tear line.

FIG. 6 is a front partial orthogonal sectional view of one embodiment of a tear line taken along a plane perpendicular to its lengthwise direction. A frangible portion 16 is generally a weakened portion of the base plate 22 substantially disposed at the center of the base plate 22 that has a reduced thickness compared to the base plate 22 and designed to encourage rupture as a large pressure is applied on it via the sharp point of the tip of a stake. In the preferred embodiment depicted, the tear line 28 is a triangularly profiled groove disposed on the upper surface of the frangible portion 16 leaving the frangible portion an even more severely reduced thickness, thereby facilitating rupture of the frangible portion 16 in a predictable tear pattern along the tear line 28 as a large pressure is applied on it via the sharp point of the tip of a stake. In most cases, at least one tear line 28 is disposed on the upper surface of the frangible portion 16.

Figure 7:
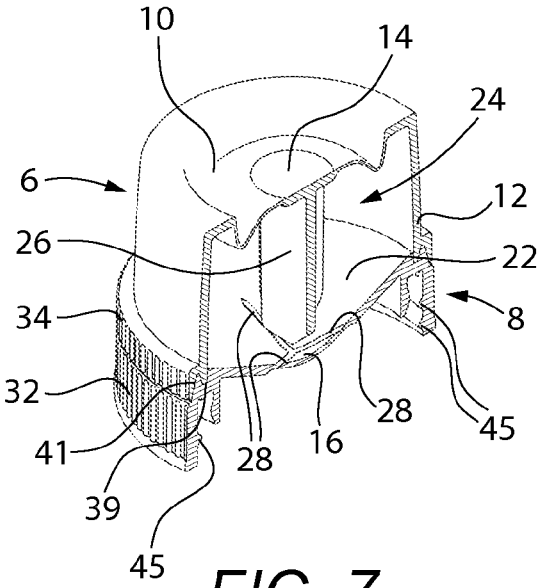
FIG. 7 is a top perspective sectional view of an assembled dispensing capsule.

FIG. 7 is a top partial perspective sectional view of an assembled dispensing capsule depicting the spatial relationships of various parts of the dispensing capsule. In this "closed position," preloaded consumable product contents (not shown) are hermetically sealed within the cavity 24 (e.g., storage receptacle) of the cup 6 by virtue of the base plate 22, the side wall 12 of the cup and the diaphragm 10, functioning as an effective seal between the storage cavity 24 and its surroundings. The cup 6 comprises a cylindrical mounting flange 34 disposed at the bottom edge of the side wall 12, the mounting flange 34 having a seal edge at its bottom periphery and an exterior peripheral surface having ribbings. The base 8 comprises a cylindrical mounting flange 32 disposed at the edge of the base plate 22, the mounting flange 32 having a seal edge at its top periphery configured to receive the seal edge of the cup's mounting flange 34 and an exterior peripheral surface having ribbings. After the cavity 24 has been filled, the cup 6 and base 8 are jointed together at their corresponding seal edges 40, 38 by means of welding. In one aspect, the seal edges are made up of a tongue and groove combination. As depicted in FIGS. 3, 4 and 7, a groove 39 is disposed on the cup's seal edge 40 while a matching tongue 41 is disposed on the base's seal edge 38. The cup's seal edge 40 is then positioned in matching abutment with the base's seal edge 38 such that the tongue 41 of the base 8 is seated snugly in the groove 39 of the cup 6. In one aspect, a seal is formed at the seal edges by spin welding. During a spin welding process, a filled cup 6 is held stationary while the base 8 is spun at high speed such that heat created by friction melts and therefore welds the seal edges 40, 38 of the cup and base together. A hermetic seal is thus formed to isolate the contents stored in cavity 24 of the dispensing capsule 2 and its surroundings. In contrast to prior art dispensing capsules utilizing snap fit or other similar conventional sealing technology, contents sealed in this manner will not leak or receive ingress of outside elements such as moisture or air. As will be appreciated, the cup 6 and base 8 may be affixed to one another in various manners and configurations. In the exemplary embodiment depicted, these component parts 6, 8 are affixed by spin welding to avoid the necessity of additional parts or adhesives. Welding the plastic provides a secure seal without small parts that may pose choking hazards or be the subject of mechanical failure. The shape and orientation of the stake 26 and tear lines 28 may vary in different embodiments, as well as the number of each.

The mounting flange 32 also provides a means for securing the dispensing capsule 2 about a receiving container (not shown). Internal threading 45 enables a selectively removable connection between the mouth of a receiving container (not shown) and the assembled dispensing capsule 2.

The frangible portion 16 and the diaphragm 10 have to be sufficiently strong to withstand pressure differentials (e.g., between the cavity 24 and the ambient environment or a receiving container attached to the base mounting flange 32) caused during manufacturing, extreme temperatures, transport and handling, pressure created by the bottle and/or cup contents, and the like. The frangible portion 16 also needs to be sufficiently fragile to be easily opened without undue activation force applied by a human finger at the diaphragm button 14. The frangible portion 16 is designed to be sufficiently strong, opening due to the mechanism of the stake 26 rather than fragility of the frangible portion 16 (or membrane). The frangible portion 16 is capable of withstanding a pressure differential equal to or greater than the gauge pressure of 14 psi (9.653 e+004 newtons/square meter). The diaphragm creates a flexible cavity 24 volume such that an excessive pressure in the sealed cavity 24 is relieved.

Figure 8:
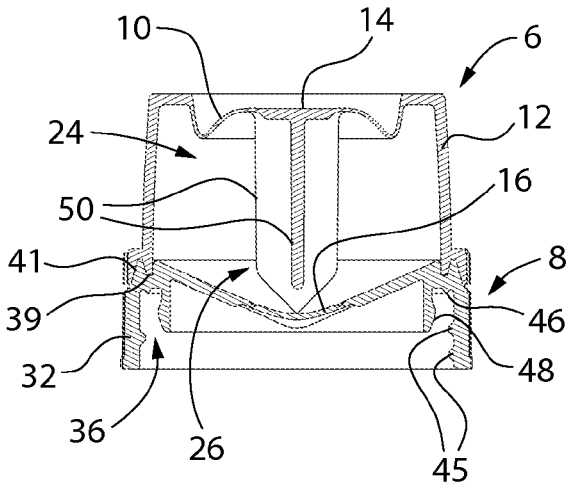
FIG. 8 is a front orthogonal sectional view of an assembled dispensing capsule.

FIG. 8 is a front orthogonal sectional view of an assembled dispensing capsule.

The diaphragm button 14 is centrally disposed on the diaphragm 10 and is operably attached to a stake 26 such that the diaphragm button 14 and stake 26 are axially aligned. The diaphragm 10 creates a flexible cavity 24 volume such that an excessive pressure differential between the sealed cavity 24 and its surroundings is relieved. As depicted, the diaphragm 10 is constructed of a flexible material capable of retaining the position of the stake 26 as the diaphragm button 14 is depressed. The cross-sectional profile of the diaphragm 10 is preferably sinusoidal. It is however noted that other equivalent profiles may also be used.

The base 8 further comprises a mounting flange 32 having a container receptacle 36 disposed on its bottom periphery and a seal edge disposed on its upper periphery. The container receptacle 36 is an inverted "U" shaped circular channel having an opening that is ready to receive the mouth of a receiving container (not shown). The container receptacle 36 comprises internal threading which cooperates with matching screw threading of a receiving container for securing the dispensing capsule 2, a wedge seal 46 which comes in compression abutment with the upper periphery of a receiving container's mouth and a bore seal 48 disposed on the opposing surface to the inner threading within the container receptacle 36 which aids in sealing the liquid contents of a receiving container therein. The mounting flange 32 thus allows the dispensing capsule 2 to function in the same manner as any bottle top or cap. It may be removed and replaced in the same intuitive manner. Since the conical shape of the base plate 22 works with gravitational force to completely empty the cavity 24, it prevents messy residue from leaking out from the frangible portion 16 when the dispensing capsule is removed for drinking after it has been actuated.

In an embodiment not depicted of the present invention, the dispensing capsule 2 comprises a plurality of cavities for storing a corresponding number of separate consumable products for mixing at the time of consumption. By way of illustration, a dispensing capsule may comprise three cavities that store separately freeze-dried coffee crystals, a granular or powdered sweetener and a powdered creamer. These consumable products mix with hot water in the receiving container to form a hot coffee drink.

FIG. 9 is a top perspective view of a dispensing capsule 2 with a diaphragm button 14 depressed. FIG. 10 is a bottom perspective bottom view of a dispensing capsule 2 with the frangible portion 16 of the base plate penetrated and opened by the stake 26 to more clearly show the result of a fully depressed diaphragm button 14. FIG. 11 is a front orthogonal sectional view of the first stage of a dispensing capsule 2 depicting the stake 26 rupturing the frangible portion 16 of the base plate 22 to result in an aperture in the frangible portion 16 of the base plate 22.

As will be readily appreciated, the stake 26 preferably has an equal or greater number of stress concentrating ribs 50 than tear lines 28 in the frangible portion 16 of the base plate 8. In the embodiment depicted, the stress concentrating ribs 50 encompass a cross sectional diameter that is substantially constant at the end where the stake 26 is attached to the diaphragm 10 but tapers to a conically shaped sharp point away from the diaphragm 10 and as it approaches the tip 27. When the diaphragm button 14 is actuated, it thrusts the stake 26 into and through the frangible portion 16 of the base plate 22, thereby causing the initial rupture, forming an aperture. In most cases, the stake tip 27 is considerably sharp and encompasses a very small surface area as defined by the small diameter 54 portion of the stake. The initial activation force (pressing the diaphragm button 14) is applied to the frangible portion 16 over that very small area which develops an incredible pressure, easily rupturing it.

Figure 12:
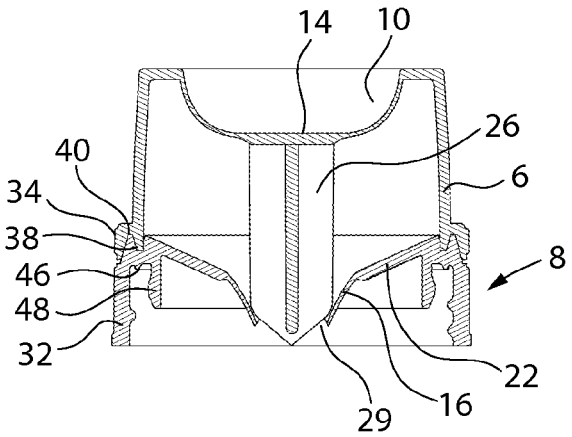
FIG. 12 is a front orthogonal sectional view of the second stage of a dispensing capsule depicting the stake forcing the aperture to enlarge.

FIG. 12 is a front orthogonal sectional view of the second stage of a dispensing capsule 2 depicting the stake 26 forcing the aperture to enlarge. Referring to FIGS. 11 and 12, after the smaller diameter portion 54 of the stake 26 has ruptured the frangible portion 16 to create an aperture, the larger diameter portion 52 provides both increased contact area and diametric reach with the frangible portion 16, applying force to the walls of the frangible portion 16 to cause the tear lines 28 to fully tear apart at greater speed than the process of rupturing the frangible portion 16. As the stake 26 continues to move down into the aperture, the stake's stress concentrating ribs 50 apply an abaxial force to the frangible portion 16. The aperture walls flex and stretch, causing the tear lines 28 to progressively open. Lesser pressure is then needed to open the aperture, thus providing an easy to use, but durable, device.

Figure 13:
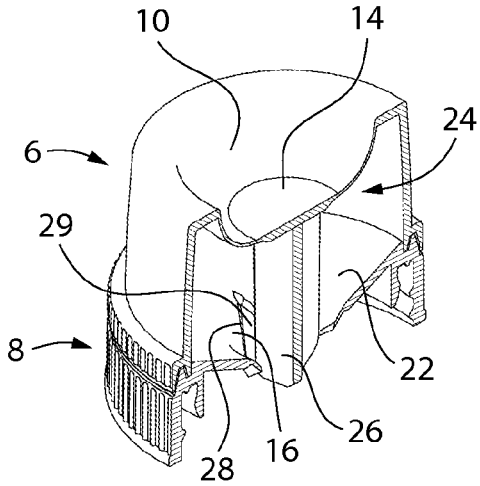
FIG. 13 is a top partial perspective sectional view of an aperture opened by a stake.
Figure 14:
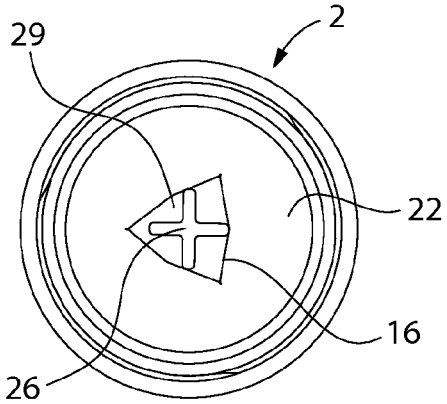
FIG. 14 is a bottom orthogonal view of an aperture opened by a stake.

FIG. 13 is a top partial perspective sectional view of an aperture in the frangible portion opened by a stake. FIG. 14 is a bottom orthogonal view of an opening 29 opened by a stake 26 to show even more clearly the aperture formed as a result of continuing to apply force to the diaphragm button after having initially puncturing the frangible portion 16. While in use, the contents of the cavity 24 are discharged into a receiving container by depressing the diaphragm button 14, thereby actuating the stake 26 to thrust toward and apply concentrated pressure abaxially to the frangible portion 16 of the base plate 22 to create an aperture and flex the aperture downwardly and outwardly to cause the at least one tear line 28 to rupture in a predictable tear pattern to create an opening.

Figure 15:
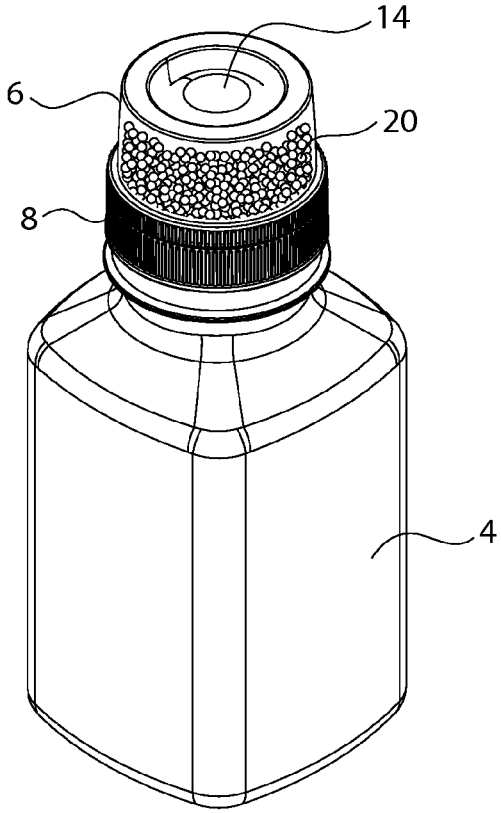
FIG. 15 is a top perspective view of a dispensing capsule on a bottle.
Figure 16:
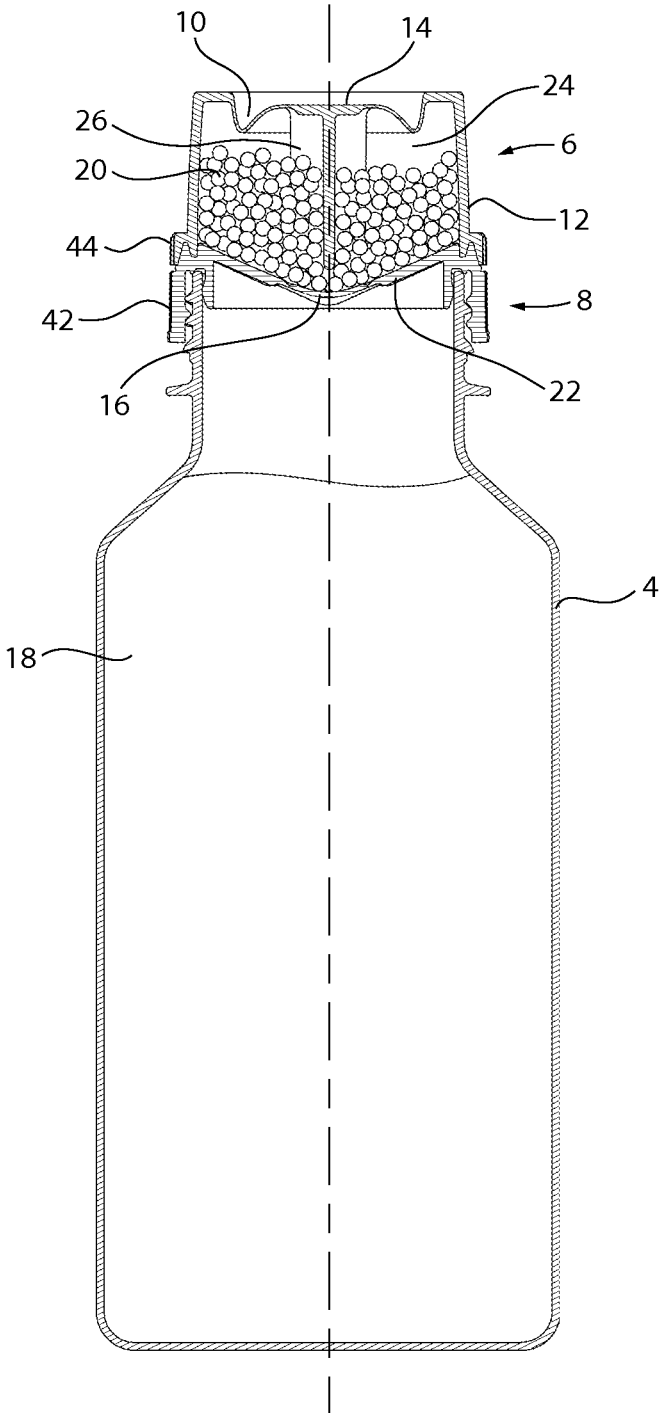
FIG. 16 is a front orthogonal sectional view of a dispensing capsule filled with material on a bottle containing water.

FIG. 15 is a top perspective view of a dispensing capsule 2 filled with material content 20 and mounted for use on a receiving container 4 (which in the illustrated case is a water bottle). FIG. 16 is a front orthogonal sectional view of the embodiment of FIG. 15. The dispensing capsule 2 is removably affixed to the mouth or opening of the receiving container 4. In this illustration, the cylindrical shaped side wall 12 is clear, or at least has sufficient transparency for its preloaded contents 20 to be visible to a user. The receiving container 4 contains liquid 18 and the dispensing capsule 2 contains a separately stored powder, crystal or granular content 20 designed to be mixed with the liquid 18 at the time of use. In one aspect, the contents 20 of the cavity 24 comprise a consumable product that is preloaded into the cavity 24 and hermetically sealed therein.

Referring to FIG. 16, the base 8 has a generally conical shaped base plate 22 with a centrally disposed frangible portion 16. In alternate embodiments (not depicted), the frangible portion 16 is not centrally located, but is located elsewhere on the base plate 22 in operative alignment with the diaphragm button 14. The conical shaped base plate 22 facilitates dispersion of the consumable product 20 contents and minimizes obstruction. Gravitational force is all that is required to urge the cavity 24 contents 20 toward the receiving container 4. When the dispensing capsule 2 is disposed in the opening or mouth of the receiving container 4 (for holding the liquid), the dispensing capsule 2 is prevented from slideable interaction and movement between the opening of the bottle 4 and the dispensing capsule 2. The exterior peripheral surfaces 42, 44 of the mounting flanges 32, 34 of the assembled dispensing capsule 2 creates gripping surfaces that may be conveniently used to grab for easy insertion and removal of the dispensing capsule 2 from the bottle opening. It should be recognized that the mounting flange 32, 34 configuration may be appropriately modified to accommodate the various structural properties of a selected receiving container 4, including, without limitation, mouth diameter, flanged mouths, threaded or unthreaded mouths, and/or the like.

Figure 17:
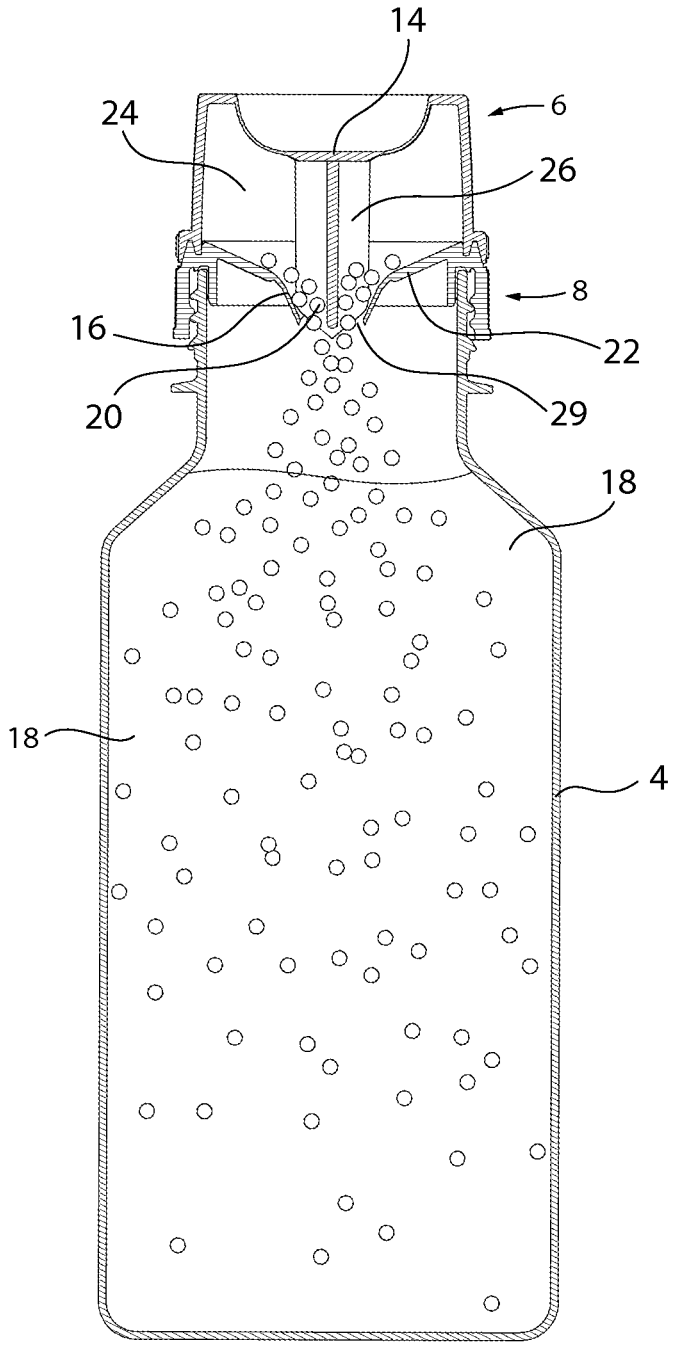
FIG. 17 is a front orthogonal view of a busted dispensing capsule dispensing dry material into water in the bottle.

FIG. 17 is a front orthogonal sectional view of a bursted dispensing capsule 2 dispensing dry material 20 into liquid 18 in the receiving container 4. The diaphragm button 14 locks in a downward position after being actuated, holding the stake 26 into the opened frangible portion 16 to maintain the opening such that the contents 20 are discharged by flowing from the cavity 24 through the opening 29 and into the receiving container 4. An activating force applied to the diaphragm button 14 causes the seal, i.e., the frangible portion 16 of the dispensing capsule's internal cavity 24 to break and dispose the dispensing capsule 2 in an open position by rupturing the frangible portion 16 in the base plate 22 of base 8. When in the open position, the cavity 24 of the cup 6 is in fluid communication with the fluid compartment of the receiving container 4.

To place the dispensing capsule 2 into an "open position", so that the contents of the cavity 24 may be introduced or discharged into the communicating receiving container 4, the diaphragm button 14 is sufficiently depressed or forcefully pushed to downwardly thrust the stake 26 to cause a predictable tear pattern in the frangible portion 16 such that the stake 26 is introduced into the fluid compartment of the receiving container 4, thus enabling the consumable product contents 20 to flow through the opening of the base plate 22 and into the liquid contents 18 of the receiving container 4. Preferably, the conical shaped base plate 22 facilitates such flow, and prevents settling or accumulation of the consumable product 20 thereon. The combined consumable product 20 and liquid 18 within the receiving container 4 may subsequently be agitated (shaken) without fear or risk of leakage or spillage. Following the shaking process, consumption of the fully mixed solution may be had by the user. For sake of clarity, the activation force is described in terms of pushing downwardly, however, it is to be appreciated that other configurations and directions are contemplated and considered within the spirit and scope of the present device. As will be apparent to one skilled in the art, the direction of applied force will align with the stake's 26 longitudinal axis.

Figure 18:
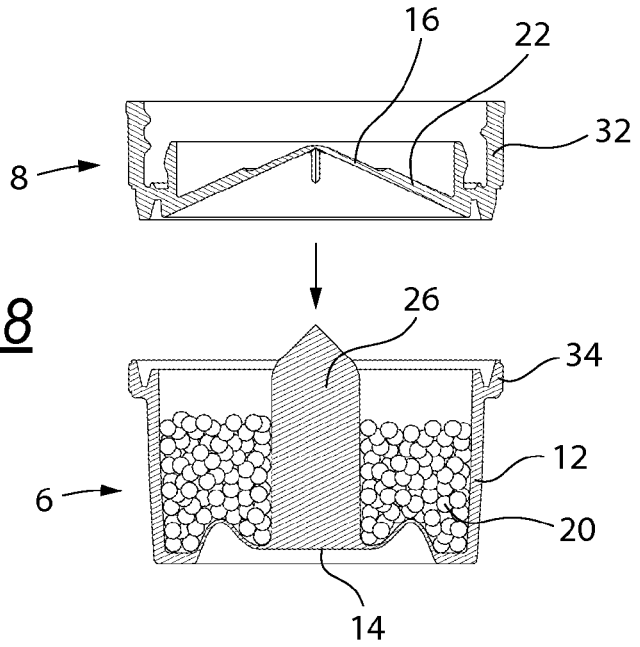
FIG. 18 is a front orthogonal sectional view of an inverted cup and base pair depicting the cup filled with material ready to receive and be jointed with the base.

FIG. 18 is a front orthogonal sectional view of an inverted cup 6 and base 8 pair depicting the cup filled with content material 20 ready to receive and be jointed with the base 8. In order to provide a preloaded sealed unit at the point of sale or end-use, the dispensing capsule 2 is preferably pre-loaded during time of manufacture with selected ingredients 20. To do this, the cup 6 is positioned with the diaphragm button 14 down and the cavity open resembling a conventional cup for filling. Once the cup 6 has been filled with the selected ingredients 20, the second component, the base 8, is jointed with the cup 6. This is typically accomplished with a weld (ultrasonic, laser, spin, stake, or "RF" Resonate Frequency), but it could be accomplished with an adhesive or a mechanical means such as mating threaded (screw) mechanisms or compression fit. Spin welding provides a durable weld securement.

The filled assembled dispensing capsule (the base-cup unit) 2 may then be threadably engaged with a bottle or other receiving container 4, preferably one prefilled with a liquid such as water. Although dispensing capsule 2 is preferably threadably engaged to the opening of a receiving container 4 (e.g., mouth of a bottle), it should be recognized that the technology of the present device may be appropriately modified to accommodate the various structural properties of any selected receiving container 4, including, without limitation, mouth diameter, flanged mouths, threaded or unthreaded mouths, and/or the like.

Figure 19:
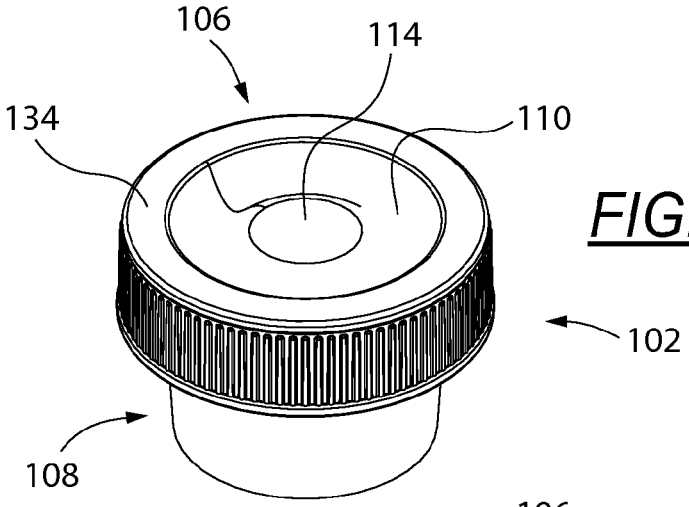
FIG. 19 is a top perspective view of an assembled dispensing capsule illustrating another embodiment for holding its contents.
Figure 20:
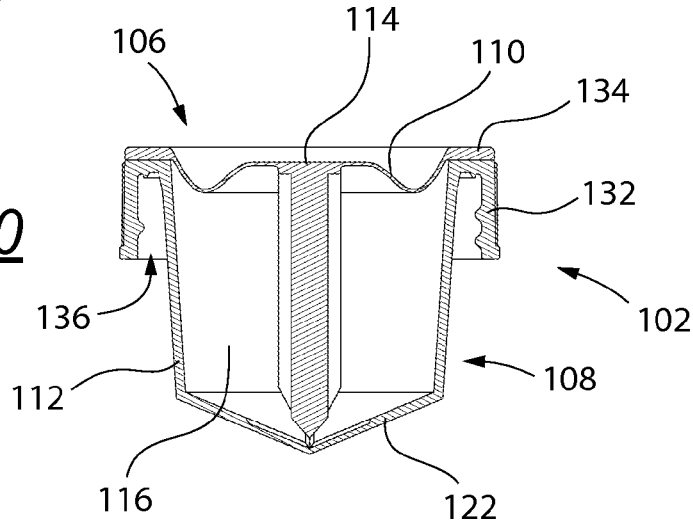
FIG. 20 is a front orthogonal sectional view of an assembled dispensing capsule illustrating another embodiment for holding its contents.

FIG. 19 is a top perspective view of an assembled dispensing capsule 102 illustrating another embodiment for holding its contents. FIG. 20 is a front orthogonal sectional view of FIG. 19. Referring to FIGS. 19 and 20, the cavity for holding dispensing capsule contents is not disposed in the cup 6 of the dispensing capsule but rather in the base 8 of the capsule 102. The dispensing capsule 102 comprises a top 106 and a base 108 jointed together, preferably by a plastic weld. The top 106 has a diaphragm 110 and a top mounting flange 134 on the circumference of the diaphragm 110. A diaphragm button 114 is centrically disposed on the diaphragm 110. The base 108 comprises a generally cylindrical side wall 112 integrally fixed to a base plate 122 having a centrically disposed frangible portion 116 and a base mounting flange 132 integrally formed along the top periphery of the cylindrical side wall 112 having a container receptacle 136 disposed on its bottom periphery. A cavity 116 is formed on the interior of the base 108 where contents 20 are stored. It is contemplated that the base 108 and its cavity 116 may be manufactured in any selected volumetric size so as to provide a variety of preloaded dispensing capsules 102. In use, the container receptacle is removably attached to the mouth of a container, making the dispensing capsule 102 substantially flush with the top of the container.

FIG. 21 is an exploded bottom perspective view of an alternate embodiment of a dispensing capsule 2 where the stake 26A is not integral with the diaphragm 10 and cup 6 and FIG. 22 is a front orthogonal sectional view thereof. While the aforementioned diagrams depict the stake 26 as integrally formed with the diaphragm 10 as a single injection molded unit, it is not so limited. In this embodiment, a connection portion 66 of stake 26A is friction fit with a receiving detent 64 centrally disposed on the interior surface of the diaphragm button 14 such that the stake 26A, frangible portion 16 and diaphragm button 14 are in axial and operative alignment. Preferably, adhesive or welding additionally secure the stake 26A in place. Mechanical fasteners may also be suitably used to secure the stake 26A to the receiving detent 64. The tip of the stake 26A is substantially similar to the stake 26 disclosed in FIG. 3. However, in this alternate embodiment, the stake 26A comprises a securing portion 67 adjacent the connection portion 66 that is increased in diameter such that when an opening is fully formed in the frangible portion 16 and if the connection portion 66 of the stake 26A dislodges from the receiving detent 64, the stake 26A is prevented from passing through the opening, thereby preventing a choking hazard from being deposited in a receiving container operably attached to the dispensing capsule 2. The securing portion 67 further serves to provide a self-standing stake 26A such that it will not tip during cup filling operations.

Figure 23:
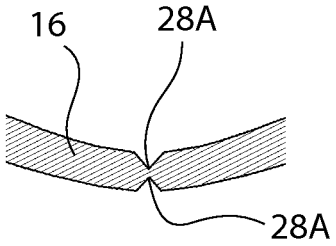
FIG. 23 is a front partial orthogonal sectional view of an alternate embodiment of a tear line.
Figure 24:
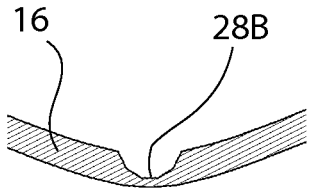
FIG. 24 is a front partial orthogonal sectional view of an alternate embodiment of a tear line.

FIG. 23 is a front partial orthogonal sectional view of an alternate embodiment of a tear line taken along a plane perpendicular to its lengthwise direction. In this embodiment, a triangularly profiled groove is disposed on each of the upper and lower surfaces of a frangible portion 16 with the tear lines 28A in substantial alignment. These tear lines can be, but are not required to have, the same depth. FIG. 24 is a front partial orthogonal sectional view of another alternate embodiment of a tear line taken along a plane perpendicular to its lengthwise direction. In this embodiment, a wider groove 28B having a concave profile is disposed on the upper surface of a frangible portion 16.

Figure 25:
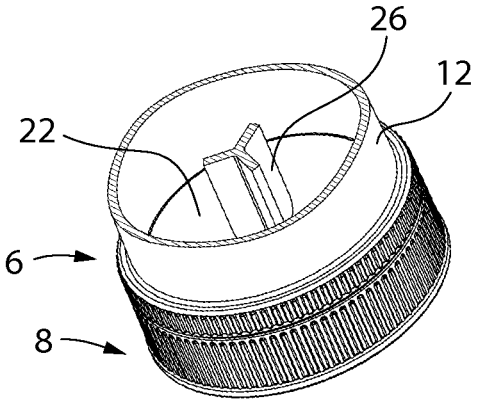
FIG. 25 is a top perspective view of a cup with the diaphragm removed to show the stake relative to the tear lines of the cup.

FIG. 25 is a top perspective view of a cup with the diaphragm 10 removed to show the stake 26 in spatial relationship to the tear lines of the cup 6. FIGS. 26-32 are described with reference to views taken from the top of the cup 6 with the diaphragm 10 removed. Applicant discovered various other stake/tear line configurations which may be used to produce desired opening in the frangible portion 16 for releasing the contents of the dispensing capsule 2. FIGS. 26-32 depict various embodiments of a stake 26 and its associated tear line pattern.

Figure 26:
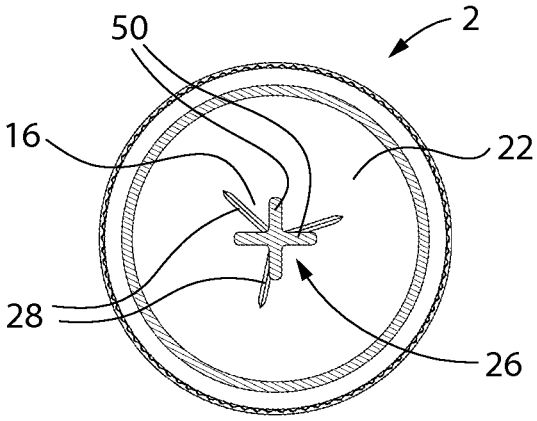
FIG. 26 is a top orthogonal sectional view of a stake with four stress concentrating ribs and a base plate with three tear lines.
Figure 27:
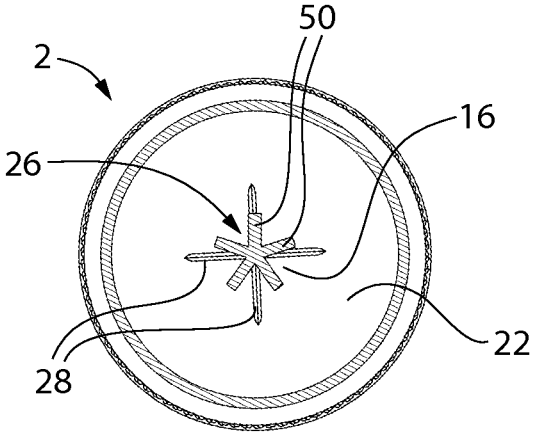
FIG. 27 is a top orthogonal sectional view of a stake with five stress concentrating ribs and a base plate with four tear lines.
Figure 28:
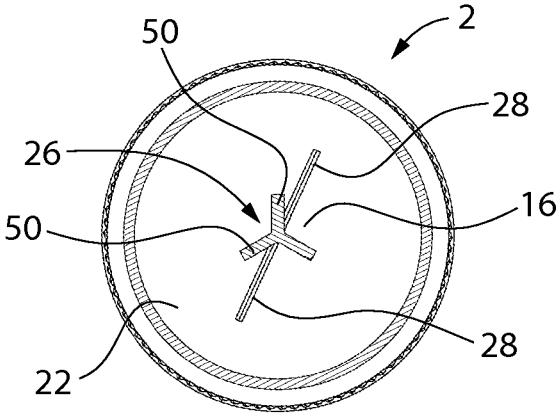
FIG. 28 is a top orthogonal sectional view of a stake with three stress concentrating ribs and a base plate with two tear lines.
Figure 29:
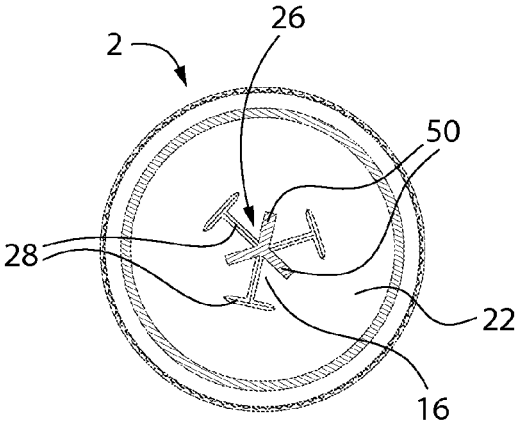
FIG. 29 is a top orthogonal sectional view of a stake with three stress concentrating ribs and a base plate with three tear lines.
Figure 30:
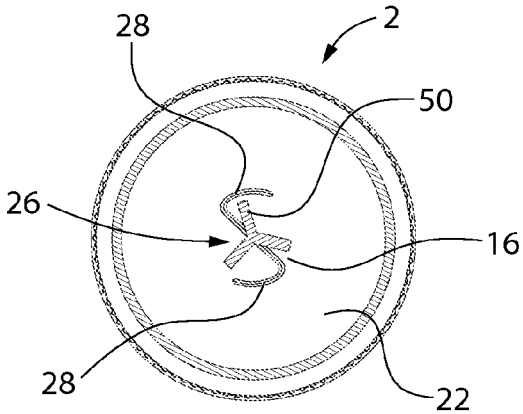
FIG. 30 is a top orthogonal sectional view of a stake with three stress concentrating ribs and a base plate with two curved tear lines.

FIG. 26 is a top orthogonal view of a stake 26 with four equiangularly spaced stress concentrating ribs 50 and a frangible portion 16 with three tear lines 28 in a tripod configuration. FIG. 27 is a top orthogonal view of a stake 26 with five equiangularly spaced stress concentrating ribs 50 and a frangible portion 16 with four tear lines 28 in a cross ("X") configuration. FIG. 28 is a top orthogonal view of a stake 26 with three equiangularly spaced stress concentrating ribs 50 and a frangible portion 16 with two tear lines 28 in a linear configuration. FIG. 29 is a top orthogonal view of a stake 26 with three equiangularly spaced stress concentrating ribs 50 and a frangible portion 16 with three tear lines 28 in a tripod configuration. FIG. 30 is a top view of a stake 26 with three equiangularly spaced stress concentrating ribs 50 and a frangible portion 16 with two curved tear lines in an "S" configuration such that the "S" is centrically disposed on the upper surface of the frangible portion 16.

Figure 31:
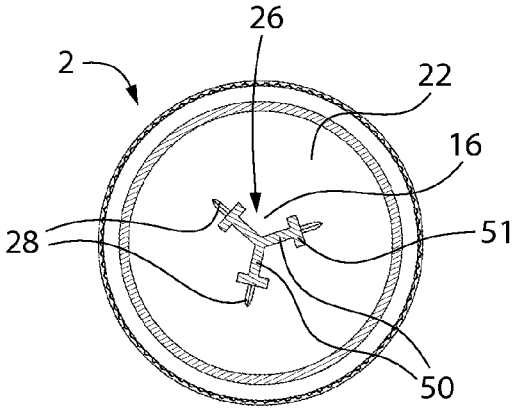
FIG. 31 is a top orthogonal sectional view of a stake with three stress concentrating ribs and a base plate with three tear lines.
Figure 32:
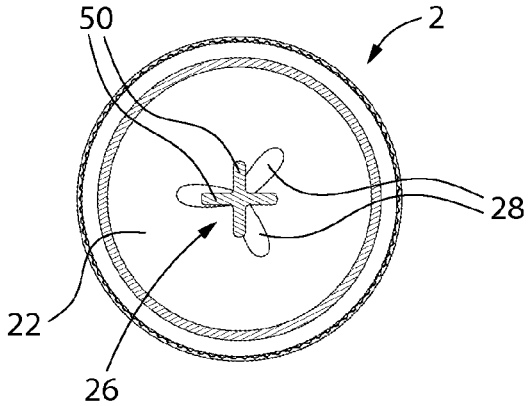
FIG. 32 is a top orthogonal sectional view of a stake with four stress concentrating ribs and a base plate with three tear lines.

FIG. 31 is a top orthogonal sectional view of a stake with three stress concentrating ribs 50 and a base plate 22 with three tear lines depicting the aligned orientation of the stake's stress concentrating ribs 50 and the frangible portion's tear lines 28. The stake 26 and tear lines 28 may optionally be configured such that the stress concentrating ribs 50 land between tear lines 28 when the frangible portion 16 is contacted. In this embodiment, each of the radially extending stress concentrating ribs is terminated with short rib 51 at substantially right angle at the periphery of each stress concentrating ribs to aid in breaking the frangible portion 16. FIG. 32 is a top orthogonal sectional view of a stake with four stress concentrating ribs 50 and a base plate 22 with three tear lines depicting the tear lines 28 having variable widths across their lengths.

In the examples illustrated in FIGS. 26, 27, 28, 30, 32, there are a greater number of stress concentrating ribs 50 than tear lines 28 and the stress concentrating ribs 50 are oriented such when actuated, they contact the frangible portion 16 between the tear lines 28 (and thus are not aligned with the tear lines 28).

As illustrated in FIGS. 26-32, the stake 26 may take various shapes and configurations. Referring back to FIG. 11, each stake 26 comprises a smaller diameter portion 54 that makes initial contact with the frangible portion 16 to puncture therethrough and a larger diameter portion 52 that applies force to the frangible portion 16 wall to tear along the tear lines 28. Thus, opening the frangible portion 16 is a two step process with an initial puncturing contact with the center of the frangible portion 16 followed by contact of the frangible portion walls with a greater surface area of the stress concentrating ribs 50 at their larger diameter portion 52 to further tear and break the frangible portion along the tear lines 28.

The stake 26 also has voids between the stress concentrating ribs 50 that facilitate the flow of the contents 20 through the aperture. FIGS. 26-32 depict stakes having stress concentrating ribs that are extending radially outwardly from the longitudinal axis of the stake and disposed equiangularly. This configuration enables contents to be disposed in abutment with the stake and minimizes the barrier for material release from the capsule once an aperture has been formed in the base plate.

Referring to FIGS. 26-32, preferably, the stake 26 comprises a plurality of stress concentrating ribs 50. These stress concentrating ribs 50 may be symmetrically or asymmetrically disposed about the periphery of the stake 26. In the illustrations, the stress concentrating ribs 50 are equiangularly disposed from one another; however, this is not required. A stress concentrator may additionally or alternatively be incorporated in the frangible portion 16 (not depicted). The stress concentrating ribs 50 can be configured such that they are aligned with the tear lines 28 when they contact the frangible portion 16 provided they have additional features that aid in breaking the tear lines such as those demonstrated in FIG. 31.

The stress concentrating ribs 50 of the stake 26 preferably do not all fall on (in axial alignment with) the tear lines 28 when initially contacting them during actuation of the stake 26. Preferably, at least some stress concentrating ribs 50 fall on the frangible portion 16 between the tear lines 28 in order to flex the frangible portion walls abaxially and open it 16. In one embodiment, this is accomplished by orientation. The cup 6 and base 8 are assembled with such axial angle orientation that at least some of the stress concentrating ribs 50 fall in-between tear lines 28. In another embodiment, this is accomplished without orientation. In this configuration, the cup 6 and base 8 are assembled with no axial angle orientation so some stress concentrating ribs 50 can fall on tear lines 28. In the latter configuration, there is preferably a greater number of stress concentrating ribs than tear lines such that it becomes impossible for all of the stress concentrating ribs to fall in alignment or become aligned with tear lines.

In one aspect, the stake's plurality of stress concentrating ribs 50 are disposed in a multitude of orientations and configured to cause turbulence during agitation of a receiving container such that a more rapid mixing of the contents dispensed from the capsule with a liquid in the receiving container.

FIGS. 33-40 are partial perspective views of various novel embodiments of a stake 26 of the present invention, illustrating the various designs of the tip 27 and stress concentrating ribs 50 of a stake 26. Each partial stake is shown inverted to better depict detailed features of the stake 26. It is to be understood that various other embodiments may be used in conjunction with various types of frangible portions 16. However, it should be noted that the various designs of the tip 27 of the stake 26 share several common features which enable the stake 26 of the present invention to function effectively. The tip of each stake 26 comprises a pointed feature, i.e., a reduced area designed to come in contacting engagement with a frangible portion 16 disposed on a base plate 22 of the base 8 as depicted in FIG. 11. The pointed feature does not necessarily need to be centrically disposed with respect to the base plate but should generally be disposed within an area of the base plate that is sufficiently weakened with a feature such as tear lines, reduced thickness and the like. As one traverses away from the tip 27 of and into the body of the stake 26, the cross-sectional profile of the stake becomes either progressively or abruptly larger in diameter until it reaches a substantially constant width which spans the rest of the length of the stake 26 to where the stake 26 is fixedly attached to a diaphragm 10. Each stake comprises at least two stress concentrating ribs 50 that are not co-planarly aligned. As such, the diametric reach of the stress concentrating ribs 50 is increased. By having at least two non co-planarly aligned stress concentrating ribs 50, the assembly of the cup 6 and base 8 may be simplified due to the lack of orientation dependence of the stake 26 with respect to the tear lines 28 disposed on the frangible portion 16.

Figure 33:
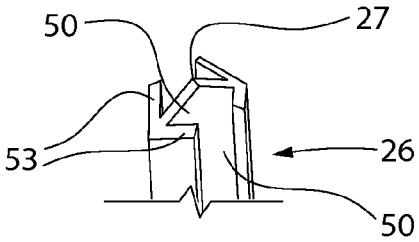
FIGS. 33-40 are partial perspective views of various embodiments of a stake.

FIG. 33 depicts a partial perspective view of the tip 27 of a stake 26 showing a pointed end formed by two primary stress concentrating ribs 50, each tapering to an end that is terminated by two narrow ribs 53 that are disposed in such a manner that the transverse cross-sectional profile of the stake 26 resembles two arrows connected at their tail ends with their head ends pointing away in opposing directions.

Figure 34:
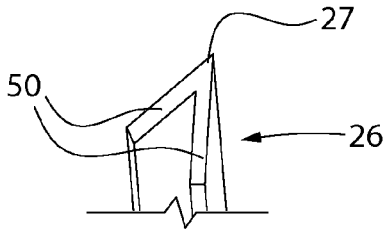

FIG. 34 depicts a partial perspective view of the tip 27 of a stake 26 showing a pointed end formed by two stress concentrating ribs 50 which is disposed non concentrically with respect to the transverse cross-sectional profile of the stake 26.

Figure 35:
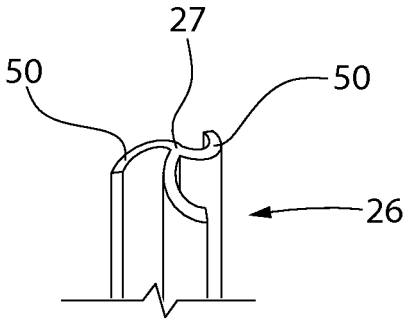

FIG. 35 depicts a partial perspective view of the tip of a stake 26 showing a pointed end formed by three equiangularly disposed but curved stress concentrating ribs 50.

Figure 36:
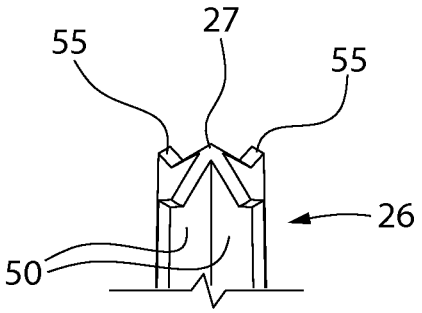

FIG. 36 depicts a partial perspective view of the tip 27 of a stake 26 showing a pointed end formed by four equiangularly disposed stress concentrating ribs 50, each tapering to an end that is terminated by a pointed end 55.

Figure 37:
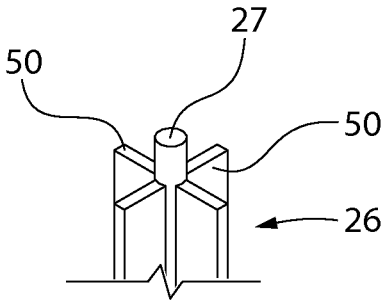

FIG. 37 depicts a partial perspective view of the tip 27 of a stake 26 showing a pointed end formed by a longitudinal end of a cylinder and four equiangularly disposed stress concentrating ribs 50.

Figure 38:
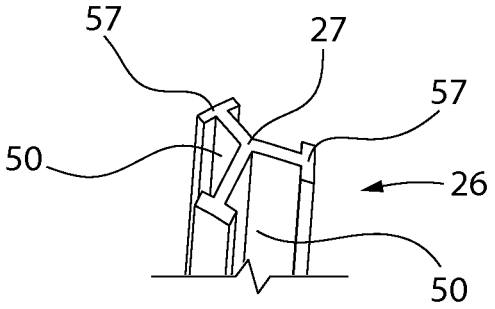

FIG. 38 depicts a partial perspective view of the tip 27 of a stake 26 showing a pointed end formed by three primary stress concentrating ribs 50, each tapering to an end that is terminated by a narrow rib 57 that is transversely disposed to each primary stress concentrating rib 50.

Figure 39:
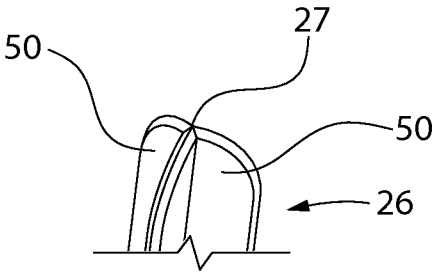

FIG. 39 depicts a partial perspective view of the tip 27 of a stake 26 showing a pointed end formed by three equiangularly disposed stress concentrating ribs 50, each parabolically tapering to substantially constant width.

Figure 40:
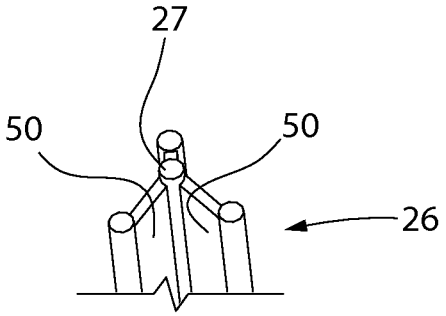

FIG. 40 depicts a partial perspective view of the tip 27 of a stake 26 showing a pointed end formed by a longitudinal end of a cylinder and three equiangularly disposed stress concentrating ribs 50, each tapering to an end that is terminated by a pointed end formed by a longitudinal end of a cylinder.

FIGS. 41-44 are partial perspective views of various embodiments of a base plate 22 of the present invention, illustrating the various designs of the base plate 22 in general and the frangible portion 16, more specifically. It is to be understood that various other embodiments may be used in conjunction with various types of stakes 26. The base plate 22 can have additional features to function properly. As disclosed in FIGS. 41-44, various other embodiments are suitable to be used in conjunction with the stake 26. However, it should be noted that the various designs of the base plate 22 and frangible portion 16 share several common features which enable the frangible portion 16 and the base plate 22 of the present invention to function effectively. The frangible portion 16 is substantially centrically disposed on the base plate 22 and comprises a weakened portion that is pierceable and frangible when coming in contacting engagement with the stake 26 as illustrated in FIG. 11. The frangible portion 16 is generally conically shaped such that the dispensing capsule's contents can be emptied by gravity alone.

Figure 41:
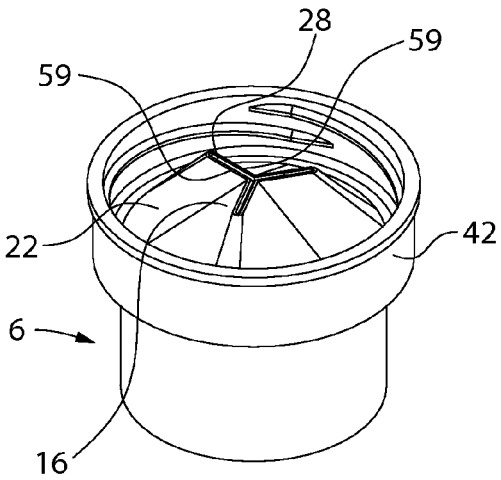
FIGS. 41-44 are partial perspective views of various embodiments of a base plate.

FIG. 41 depicts a perspective view of an inverted dispensing capsule 2 showing a base plate 22 design. The base plate 22 comprises a frangible portion 16 having three tear lines 28 disposed on the seam of three equiangularly disposed folds 59. When the frangible portion 16 is forced open at tear lines 28, the folds proceed to unfurl, substantially increasing the size of an opening formed as a result of the tearing of the frangible portion 16, thereby increasing the dispensing effectiveness of the frangible portion 16.

Figure 42:
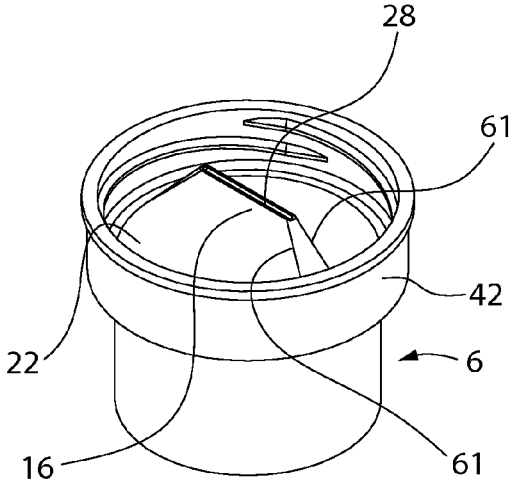

FIG. 42 depicts a perspective view of an inverted dispensing capsule 2 showing another base plate 22 design. The base plate 22 comprises a frangible portion 16 having one tear line disposed on the seam of two folds. When the frangible portion 16 is forced open at the tear line 28, the fold proceeds to unfurl, substantially increasing the size of an opening formed as a result of the tearing of the frangible portion 16, thereby increasing the dispensing effectiveness of the frangible portion 16.

Figure 43:
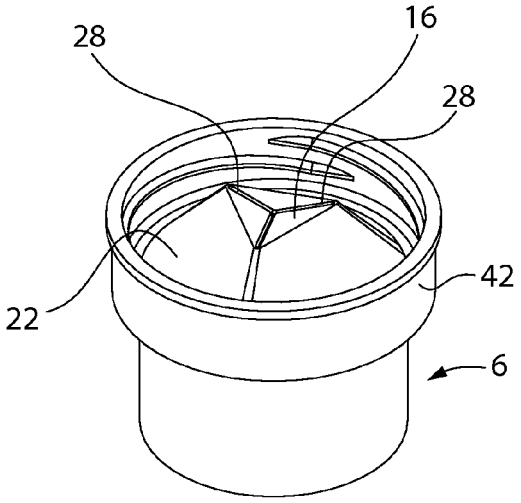

FIG. 43 depicts a perspective view of an inverted dispensing capsule 2 showing another base plate 22 design. The base plate 22 comprises a frangible portion 16 having three polyhedral depending surfaces terminated at its apex with a substantially flat triangular frangible portion 16 having three equiangularly disposed tear lines 28, each tear line intersecting a vertex of the triangularly shaped frangible portion 16 surface.

Figure 44:
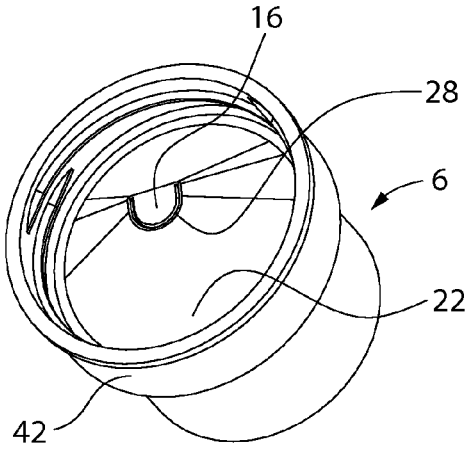

FIG. 44 depicts a perspective view of an inverted dispensing capsule 2 showing another base plate 22 design. The base plate 22 comprises a substantially conical, frangible portion 16 having a tear line 28 configured to outline the periphery of a door. When the frangible portion 16 is forced open at the tear line 28, a flap is pushed outwardly from the cavity of the dispensing capsule, thereby allowing the contents of the capsule to be emptied.

Figure 45:
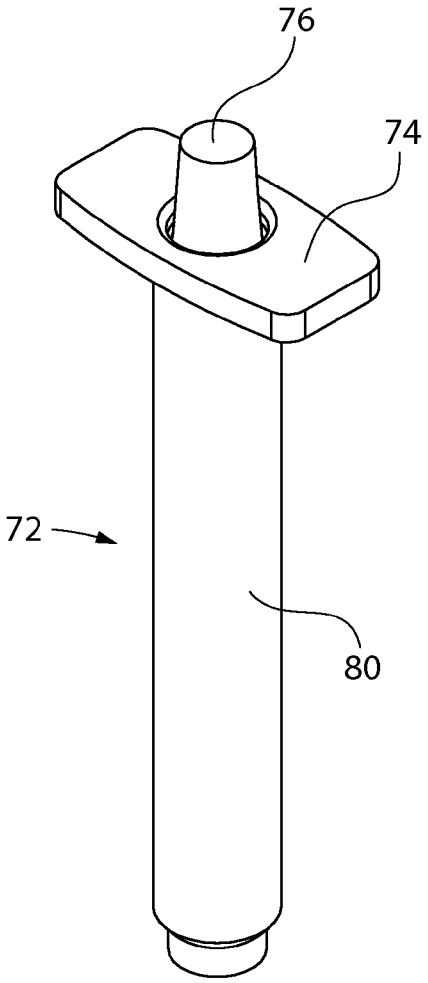
FIG. 45 is a top perspective view of a dispensing capsule in the form of an injection pen.
Figure 46:
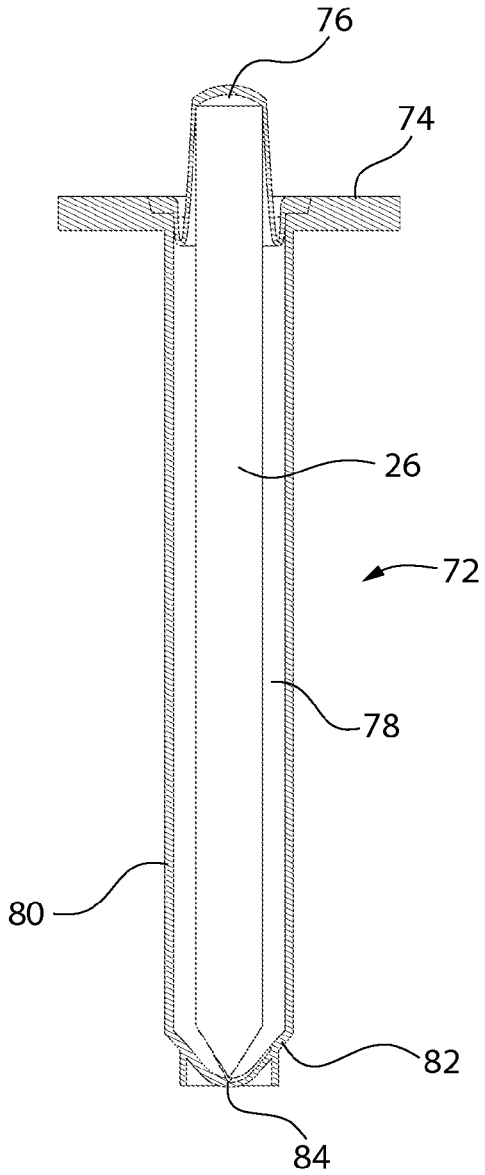
FIG. 46 is a front orthogonal sectional view of the injection pen dispensing capsule depicted in FIG. 45.

FIG. 45 is a top perspective view of a dispensing capsule 72 in the form of an injection pen. FIG. 46 is a front orthogonal sectional view of the injection pen dispensing capsule 72 depicted in FIG. 45. FIGS. 45 and 46 depict an embodiment where the dispensing capsule 72 is configured in the form of a syringe style device having a protruding lip 74 for fingers to grip during use. The base 80 may be cylindrical as illustrated or have other convenient tubular configurations.

An activating force applied to the diaphragm button 76 causes the seal of the dispensing capsule's internal cavity 78 to break and dispose the dispensing capsule 72 in an open position by rupturing the frangible portion 84 in the base plate 82 of base 80.

Figure 47:
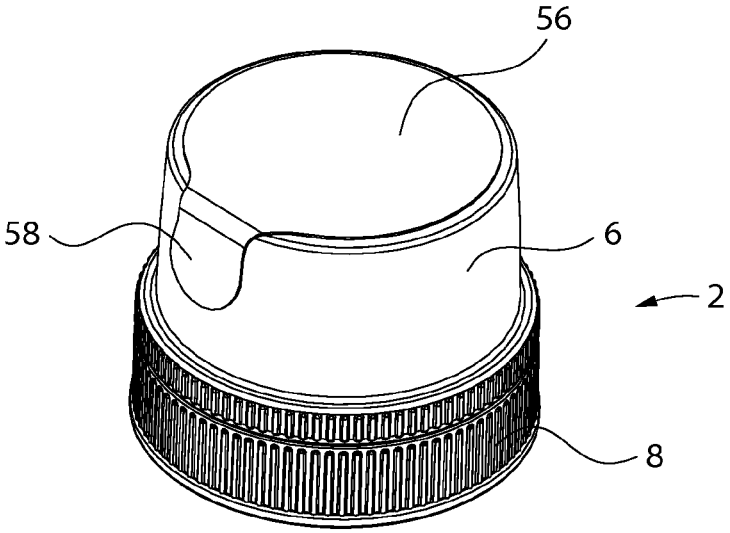
FIG. 47 is a top perspective view of a label affixed to the top of a dispensing capsule.
Figure 48:
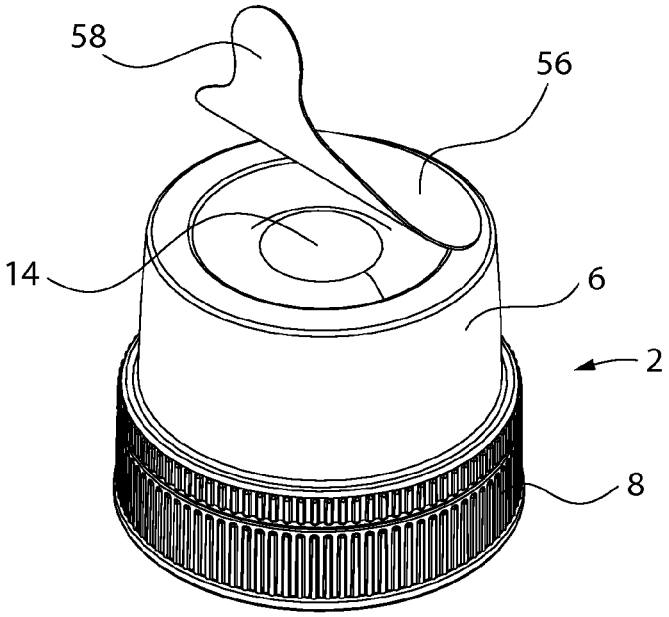
FIG. 48 is a top perspective view of a label being peeled from a dispensing capsule.

FIG. 47 is a top perspective view of a label affixed to the top of a dispensing capsule 2. FIG. 48 is a top perspective view of a label 56 being peeled from a dispensing capsule 2. In one aspect depicted in FIGS. 47 and 48, the dispensing capsule 2 provides an optional label 56 for displaying various indicia such a logos, product identification, ingredients, flavors, instructions, expiration dates, price or the like. Disposing this label 56 over the diaphragm button 14 protects against unintentional actuation during storage and handling. Pull tab 58 provides a convenient means for lifting and peeling back label 56 to reveal the diaphragm button 14 beneath.

Figure 49:
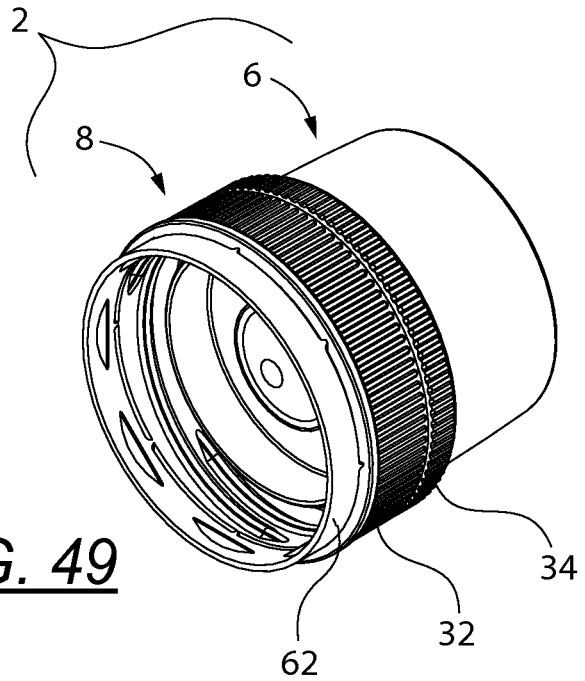
FIG. 49 is a bottom perspective view of a dispensing capsule with drop band (tamper evident band).
Figure 50:
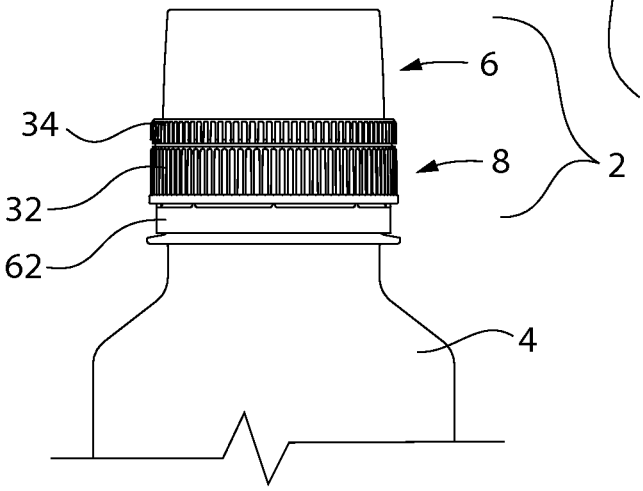
FIG. 50 is a front orthogonal view of a dispensing capsule with a drop band on the bottle.
Figure 51:
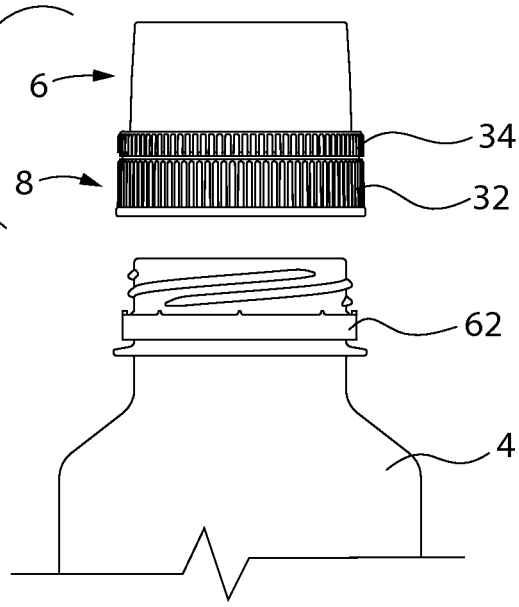
FIG. 51 is a front orthogonal view of a dispensing capsule removed from a bottle with the drop band remaining on the bottle.

FIG. 49 is a bottom perspective view of a dispensing capsule 2 with drop band 62 that functions as tamper evident band. FIG. 50 is a front orthogonal view of a dispensing capsule 2 with a drop band 62 on the bottle 4. FIG. 51 is a front orthogonal view of a dispensing capsule 2 removed from a bottle 4 with the drop band 62 remaining on the bottle 4. In some aspects, a drop band 62 is provided along the bottom edge of the base 8 or its mounting flange 32 to function as a tamper evident seal. The dispensing capsule 2 is packaged with the drop band 62 attached to the bottom edge of the base or its mounting flange 32. Once the dispensing capsule 2 has been removed from the bottle 4, the drop band 62 is left attached to the bottom's neck. The concept of using a drop band for tamper evidence is well known in the industry and any known or developed configuration may be suitably adapted.

Figure 52:
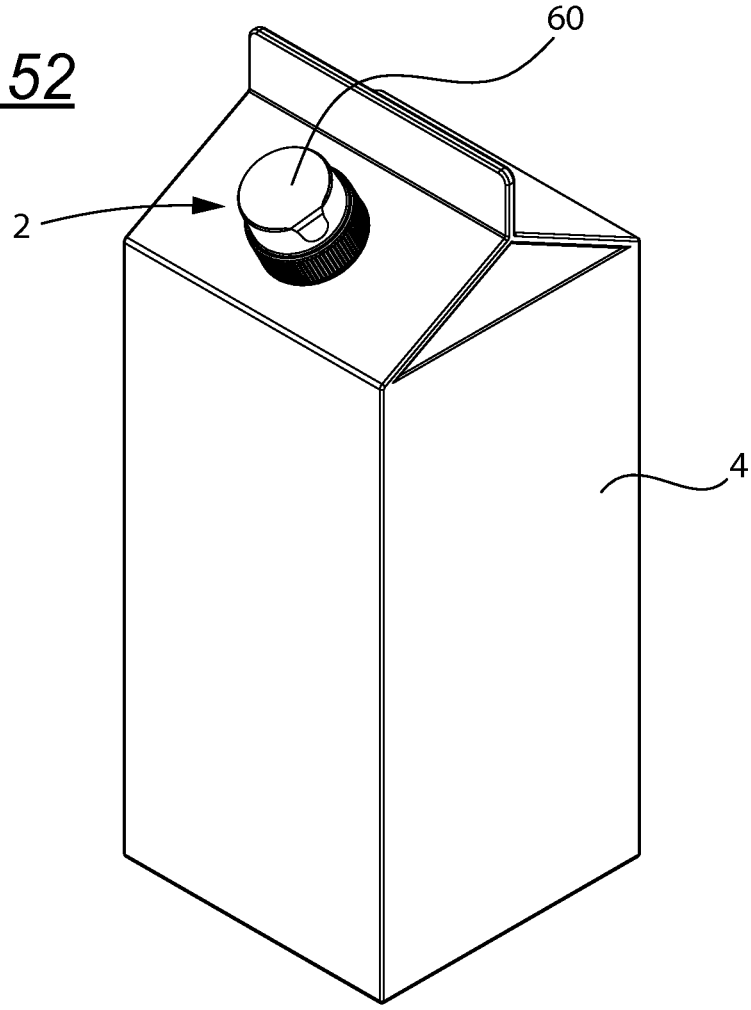
FIG. 52 is a top perspective view of a capped milk or juice container with a tamper evident seal affixed.
Figure 53:
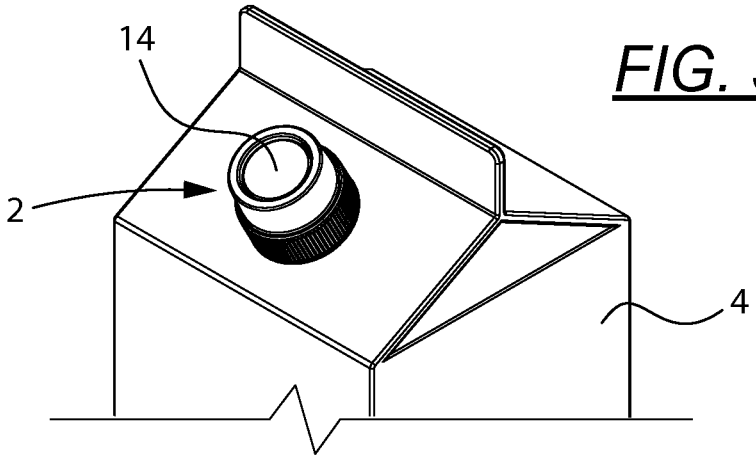
FIG. 53 is a partial top perspective view of the capped milk or juice container depicted in FIG. 52 with a tamper seal removed.

FIG. 52 is a top perspective view of a capped milk or juice container 4 with a tamper evident seal 60 affixed on a dispensing capsule 2. FIG. 53 is a partial top perspective view of the capped milk or juice container 4 depicted in FIG. 52 with a tamper evident seal 60 removed to reveal the diaphragm button 14 beneath.

Figure 54:
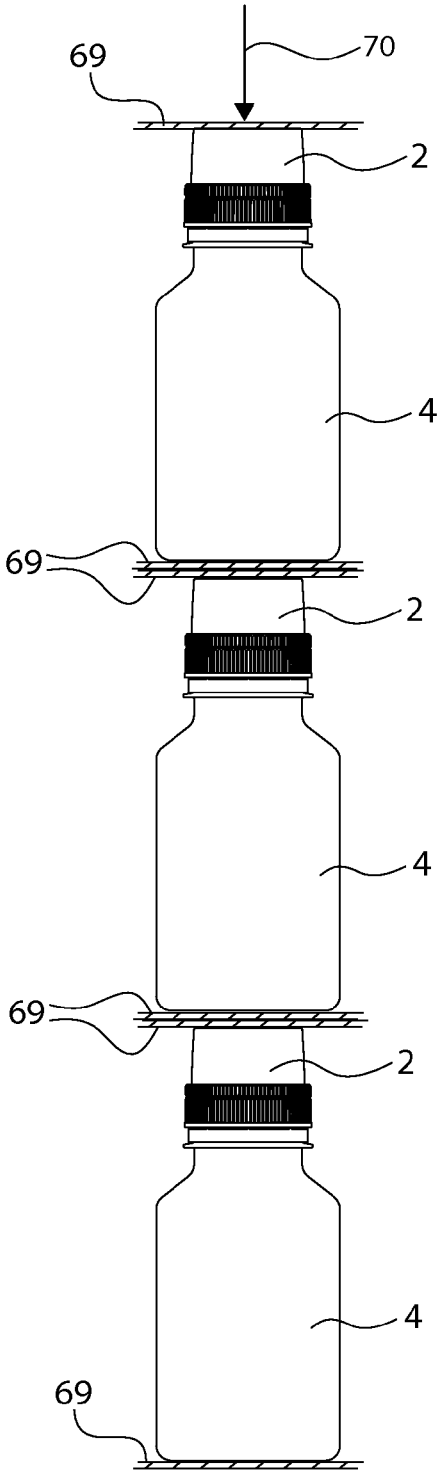
FIG. 54 is a front partial orthogonal view of capped bottles illustrating how they would stack in boxes and carry load exerted on them.

FIG. 54 is a front partial orthogonal view of mounted dispensing capsules 2 on receiving containers 4 illustrating how they would stack in boxes and carry the load exerted on them by capped and loaded bottles 2, 4 stacked on them or an external load 70. It is a common practice to transport capped and loaded bottles in cardboard boxes 69 or cardboard layered 69 boxes. As illustrated in FIG. 54, the present capsules have sufficient structural strength to overcome load exerted on them such that they stay intact while being transported. The load is distributed over the shoulder of the cup and the depressed diaphragm button prevents actuation in this stacked arrangement.

Figure 55:
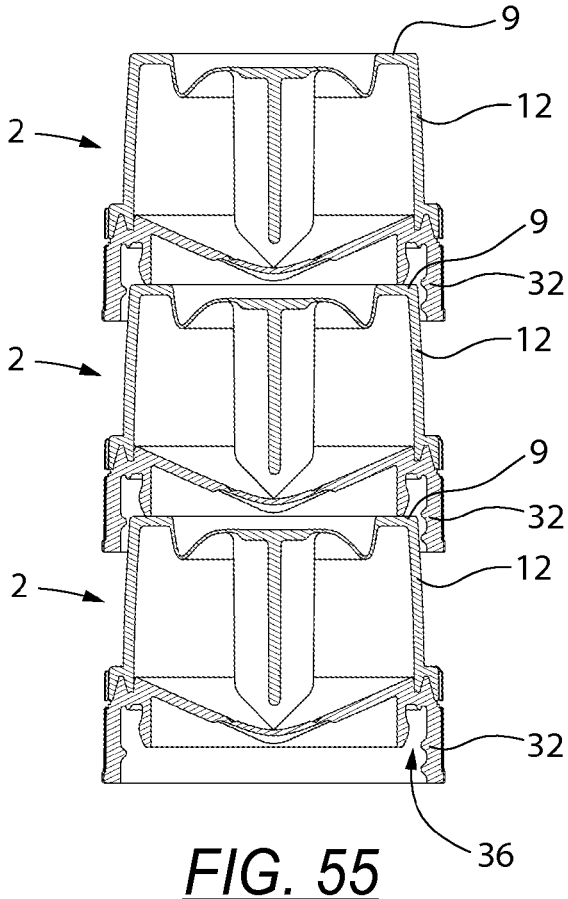
FIG. 55 is a front orthogonal sectional view of capsules stacked and nested for transport.
Figure 56:
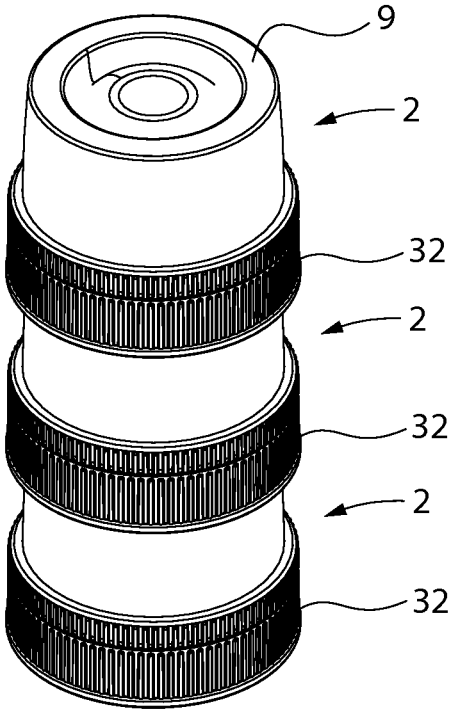
FIG. 56 is a top perspective view of capsules stacked and nested.

FIG. 55 is a front orthogonal sectional view of three dispensing capsules 2 stacked and nested for transport, retail, storage and the like. FIG. 56 is a top perspective view of the dispensing capsules 2 stacked and nested. Referring to FIGS. 55 and 56, the cylindrical side wall 12 of the cup preferably protrudes above the diaphragm 10 of the dispensing capsule 2 to form a shoulder 9, resulting in a planar surface such that dispensing capsule 2 units may be conveniently stacked for storage and transportation. As will be apparent, the outer circumference of the shoulder 9 is preferably smaller than the inner circumference of the base's container receptacle 36 such that the assembled units conveniently nest together. In one embodiment, the mounting flange 32 is configured to cooperate with a thirty eight millimeter bottle 4 opening (mouth).

Applicant further discovered that various equivalently shaped diaphragm or frangible portions may also be used.

Figure 57:
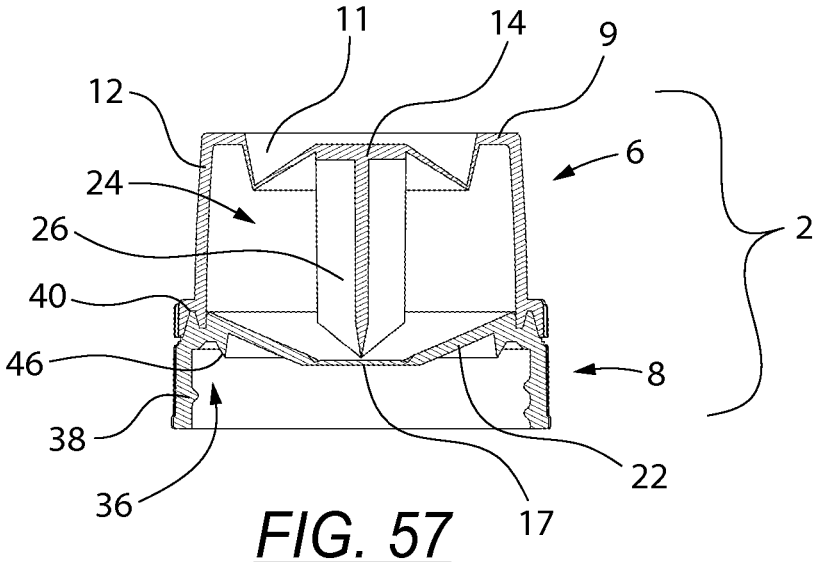
FIG. 57 is a front orthogonal sectional view of a dispensing capsule (cup and base assembly) depicting a centrically disposed flat portion of a base plate.

FIG. 57 is a front orthogonal sectional view of a dispensing capsule 2 (cup 6 and base 8 assembly) depicting a flat frangible portion 17 of a base plate 22 and a diaphragm 11 having a saw-toothed profile. In contrast to the dispensing capsule 2 disclosed in FIG. 8, the dispensing capsule disclosed in this embodiment has a base that comprises a flat frangible portion 17 and a diaphragm 11 having a saw-toothed profile instead of the sinusoidal (rippled) profile of the embodiment disclosed in FIG. 8. It should be noted that a bore seal 48 can be eliminated from such a configuration leaving only the wedge seal 46 to cooperate with the base mounting flange 32 and the mouth of a receiving container (not shown) to provide sealing of its liquid contents therein since the flat frangible portion 17 is able to provide support if multiple dispensing capsules are stacked in such a manner that a cup's shoulder 9 and side wall 12 are brought in contacting engagement with container receptacle 36 as depicted in FIG. 55. Absent a bore seal 48, the base can be manufactured using a simpler process, thereby reducing the cost and part reject rate associated with it.

Figure 58:
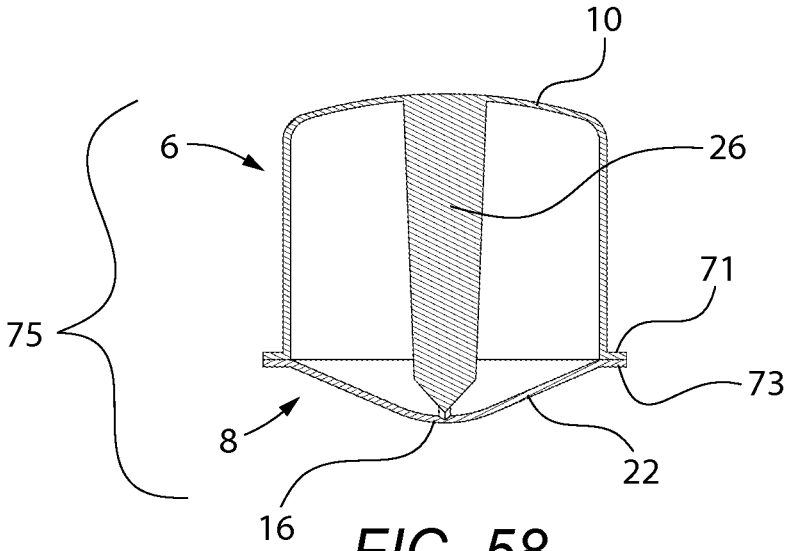
FIG. 58 is a front orthogonal sectional view of one embodiment of the present invention illustrating the use of a type of dispensing capsule that does not include an integral base mounting flange, whereby the capsule is mountable to a receiving container via friction/pressure fit with the aid of a separately provided mounting flange.
Figure 59:
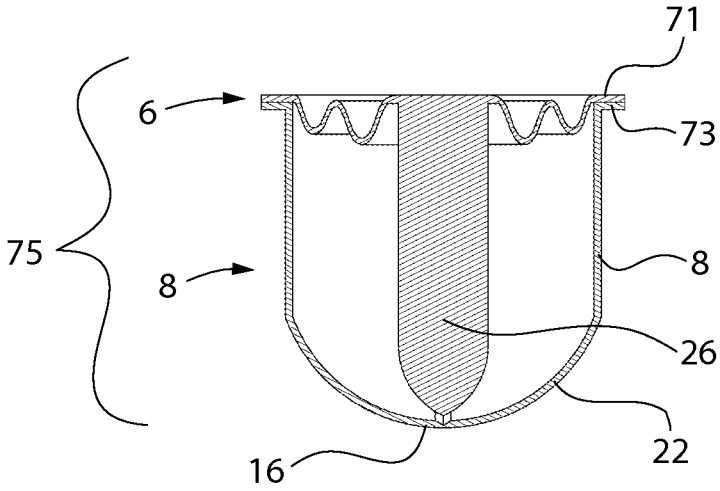
FIG. 59 is a front orthogonal sectional view of another embodiment of the present invention illustrating the use of a type of dispensing capsule that does not include an integral base mounting flange.

FIG. 58 is a front orthogonal sectional view of one embodiment of the present invention illustrating the use of a type of dispensing capsule that does not include an integral base mounting flange, whereby the capsule is mountable to a receiving container via friction/pressure fit. FIG. 59 is a front orthogonal sectional view of another embodiment of the present invention illustrating the use of a type of dispensing capsule that does not include an integral base mounting flange.

In contrast to the dispensing capsule 2 disclosed in FIG. 8, the dispensing capsules 75 of FIGS. 58 and 59 are made without a mounting flange. In order to provide grip to such a capsule, a seal edge 71, 73 is disposed on the periphery of each of the cup and base.

Figure 60:
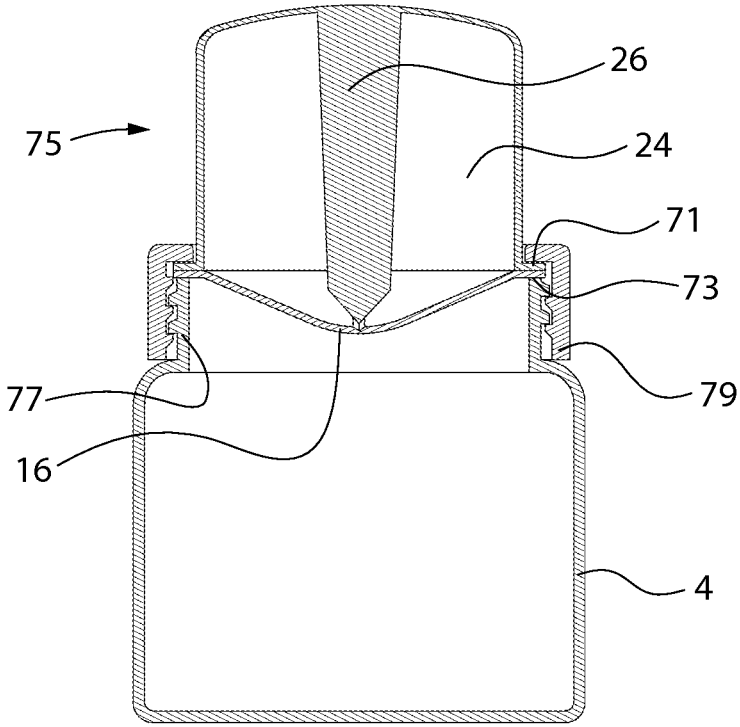
FIG. 60 is a front orthogonal sectional view of the embodiment of FIG. 58 mounted on a receiving container.

FIG. 60 is a front orthogonal sectional view of the embodiment of FIG. 58 mounted on a receiving container 4. After the cavity 24 has been filled, the seal edges 71, 73 are brought together to form a contacting abutment before they are sealed by means of adhesive, welding or other equivalent means to provide a hermetic seal to the contents. In order to secure the dispensing capsule 75 to a receiving container 4, the dispensing capsule 75 is first dropped into a screw threaded mouth 77 of the receiving container 4 with the seal edges 71, 73 resting atop the edge of the mouth 77. A separate mounting flange 79 having inner threading is then positioned over the previously affixed seal edges 71, 73 coming in securing engagement with the mouth's screw threading such that as the mounting flange 79 is rotated in the tightening direction, a progressively large pressure is exerted to press the seal edges 71, 73 against the edge of the receiving container's mouth 77, thereby sealing the liquid content of the receiving container 4 from its surroundings.

Referring again to FIG. 58, it should also be noted that the top wall of the cup is dome shaped. It is to be understood that the top wall may also assume various other configurations so long as the top wall allows the range of movement required of the stake 26 to pierce and penetrate the frangible portion 16.

Figure 61:
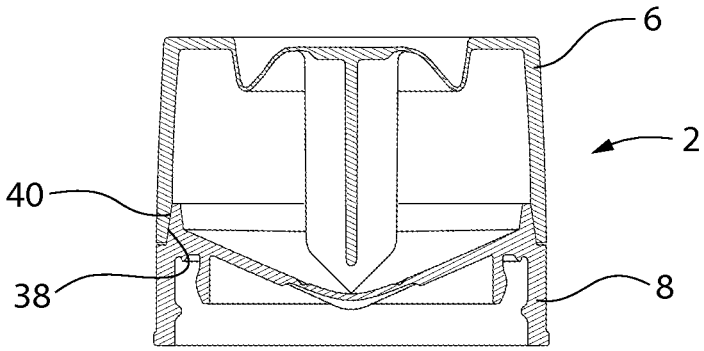
FIG. 61 is a front orthogonal sectional view of a dispensing capsule illustrating one alternate embodiment of the cup and base seal edge combination.

FIG. 61 is a front orthogonal sectional view of a dispensing capsule 2 illustrating one alternate embodiment of the cup and base seal edge combination. In this embodiment, the seal edges 40, 38 of the cup and the base are slightly tapered surfaces which are overlapped and welded as a lap joint such that the contents are hermetically sealed. It should be appreciated that the seal edges 40, 38 may take on various shapes and configurations, provided they are capable of providing matching profiles which aid in positioning and retention of a base 8 with respect to a filled cup 6 during a packaging process.

Figure 62:
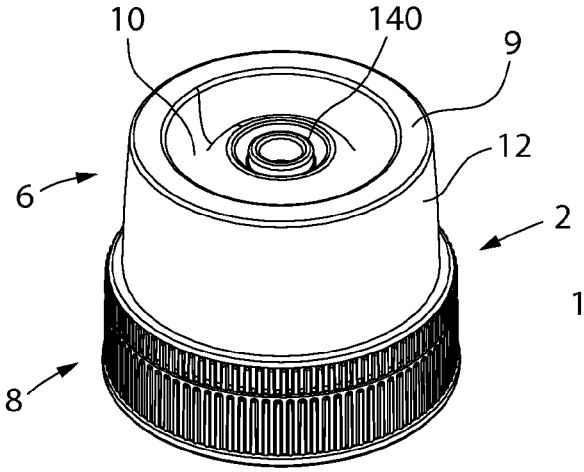
FIG. 62 is a front perspective view of an assembled dispensing capsule illustrating an embodiment of a diaphragm button used in conjunction with a cone shaped surface at the stake's base.
Figure 63:
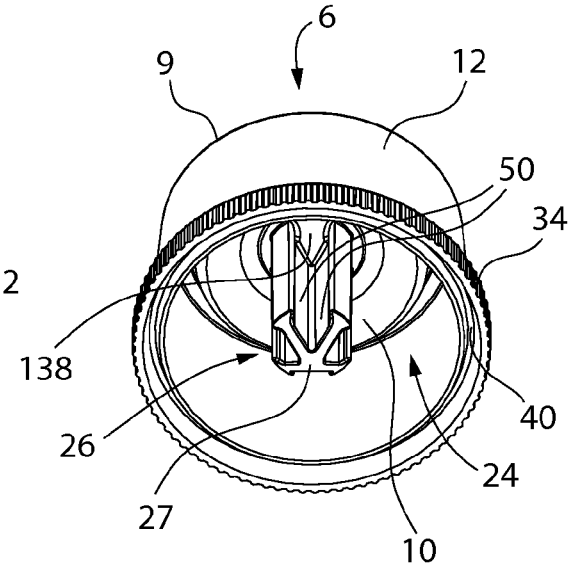
FIG. 63 is a bottom perspective view of a cup illustrating the use of a cone shaped surface at the stake's base.
Figure 64:
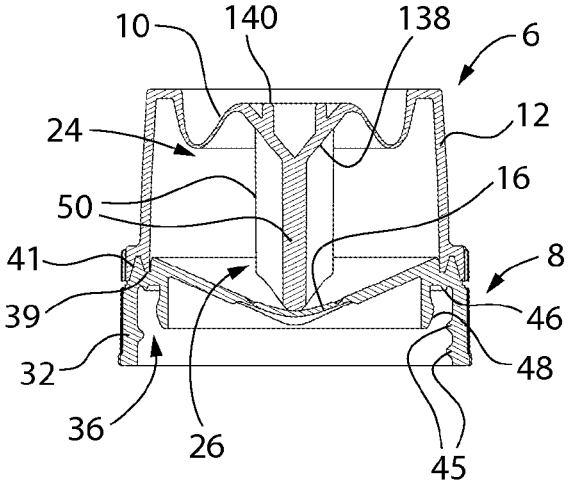
FIG. 64 is a front orthogonal sectional view of an assembled dispensing capsule illustrating the use of a cone shaped surface at the stake's base.

FIG. 62 is a front perspective view of an assembled dispensing capsule illustrating an embodiment of a diaphragm button used in conjunction with a cone shaped surface at the stake's base. FIG. 63 is a bottom perspective view of a cup illustrating the use of a cone shaped surface at the stake's base. FIG. 64 is a front orthogonal sectional view of an assembled dispensing capsule illustrating the use of a cone shaped surface at the stake's base. Referring to FIGS. 63 and 64, a cone shaped surface 138 is provided at the stake's base with the base of the cone shaped surface concentrically disposed on the stake's base. Referring to FIG. 62, there is further provided a cylindrical shaped diaphragm button 140 whose central axis is disposed coaxially with the stake's 26 central axis. A diaphragm button of various other shapes may be used provided that the button has sufficient structural integrity such that when it is depressed, an activating force for opening the frangible portion 16 is transmitted to the frangible portion 16 instead of deforming the diaphragm button 140 or the stake's base. When the diaphragm button 140 is depressed, the capsule material coming in contact with the cone shaped surface is pushed sideways, away from the stake 26, thereby facilitating the movement of the stake 26 down towards the frangible portion 16.

How the Dispensing Capsule is Used

Preloaded ingredients contained within the hermetically sealed cup may be introduced or discharged from the dispensing capsule and/or into a liquid containing receiving container (e.g., bottle) by simply depressing a button disposed on the diaphragm of the cup, thereby actuating the stake to thrust forward and apply concentrated stress abaxially to the frangible portion and flex the frangible portion walls downwardly and outwardly. This concentrated pressure pierces substantially the center of the frangible portion, causing it to rupture and progressively opening it. The diaphragm button locks in this downward position, holding the stake into the opening to maintain the opening, permitting the contents to flow through the opening and exit the cavity of the cup.

The cup-base unit, together forming the dispensing capsule, functions as a conventional bottle top. The dispensing capsule may be removed after its contents have been discharged into the bottle's liquid to facilitate drinking by a user. It may then be reinstalled as a bottle cap to seal in the contents of and protect against spillage of a partially used or open product. The design of the base is especially advantageous in that it eliminates dripping from the edges during this removal process.

Materials and Manufacturing Methods

The dispensing capsule 2 is preferably formed from a suitable plastic substrate, such as, for exemplary purposes only, polypropylene or polyethylene, and with sufficient structural rigidity to prevent deformation, breakage and/or tearing of same during manufacturing and use. The cup and base components are preferably formed via injection molding processes. Additionally, during time of manufacture, and preferably prior to assembly, of dispensing capsule 2, the cavity 24 of the cup 6 is pre-loaded with a selected dry or liquid consumable product 20 to facilitate subsequent consumer use. It should be recognized that other suitable materials or substrates may be utilized to form dispensing capsule 2, such as, for exemplary purposes only, polymers, plastics, metals, metal alloys, ceramics, or the like.

It is to be understood that the invention is not limited in its application to the details of construction and the arrangements of the components set forth in the description or illustrated in the drawings. As such, those skilled in the art will appreciate that the conception, upon which this disclosure is based, may readily be utilized as a basis for the designing of other structures, methods and systems for carrying out the several purposes of the present device. It is important, therefore, that the claims be regarded as including such equivalent construction insofar as they do not depart from the spirit and scope of the conception regarded as the present invention.

What is claimed herein is:

1. A dispensing capsule for affixing to a mouth of a receiving container, said dispensing capsule comprising:

a) a base including a generally conical shaped base plate having a concentrically disposed frangible membrane having an upper surface and a lower surface and at least one elongated tear line having a reduced thickness;

b) a cup comprising a circular diaphragm functioning as a top wall, said cup including a shoulder disposed at a periphery of the diaphragm with said shoulder protruding above the entirety of said diaphragm and a side wall extending downwardly therefrom to create an opening at an opposing end thereof and defining a cavity on an interior of the cup, and further including a diaphragm button concentrically disposed on said diaphragm; and c) a stake having a stake base fixedly attached to said diaphragm and a tip opposingly disposed from said stake base such that said diaphragm button and stake are axially aligned, said stake further including at least one stress concentrating rib extending in an abaxial relation with respect to said at least one elongated tear line;

wherein said cup and said base are affixed to one another such that frangible membrane is opposingly disposed from said diaphragm button and said base plate is in contacting engagement with said side wall of said cup to form an assembled dispensing capsule wherein said base plate forms a bottom wall which, together with said interior of said cup, defines a sealed cavity adapted to hold and store a predetermined ingredient within said sealed cavity;

and wherein said diaphragm is movable to an ingredient dispensing position by pushing said diaphragm button toward said frangible membrane which thereby causes said stake and said at least one stress concentrating rib to apply a pressure against said frangible membrane abaxially of said at least one tear line and thereby causing said at least one tear line to break and create an opening in said sealed cavity wherethrough an ingredient located within said cavity may freely pass.

2. The dispensing capsule of claim 1, wherein the ingredient of said cavity comprises a consumable product.

3. The dispensing capsule of claim 1, wherein said cup and said base are jointed together with a plastic weld.

4. The dispensing capsule of claim 1, wherein said base further comprises a cylindrical base mounting flange generally extending perpendicularly to said base plate along a periphery thereof having a receiving container receptacle disposed along a bottom periphery of said base mounting flange for receiving a receiving container, wherein said receiving container receptacle threadably connects to a mouth of the receiving container, thereby sealing liquid contents of the receiving container therein when said dispensing capsule is mounted for use on the receiving container.

5. The dispensing capsule of claim 4, wherein said receiving container receptacle comprises an inverted "U" shaped circular channel having an opening that receives the mouth of the receiving container and internal threading that cooperates with mating screw threading of the receiving container.

6. The dispensing capsule of claim 5, wherein said receiving container receptacle further comprises a wedge seal that comes in compression abutment with an upper periphery of the mouth of the receiving container and a bore seal disposed on a surface opposing the internal threading such that a seal is formed when the mouth and said receiving container receptacle are threadably engaged that seals liquid contents of the receiving container therein when said dispensing capsule is mounted for use on the receiving container.

7. The dispensing capsule of claim 1, wherein said cup further comprises a cylindrical cup mounting flange disposed along a bottom edge of said cylindrical shaped side wall, said cup mounting flange having a seal edge at its bottom periphery; and said base further comprises a cylindrical base mounting flange disposed substantially perpendicular to and along an edge of said base plate, said base mounting flange having a seal edge at its top periphery configured to receive said seal edge of said cup mounting flange.

8. The dispensing capsule of claim 7, wherein said seal edges of said cup mounting flange and said base mounting flange comprise a tongue and groove combination wherein a groove is disposed on said seal edge of said cup mounting flange and a mating tongue is disposed on said seal edge of said base mounting flange such that when said cup and said base are jointed together, said seal edge of said cup mounting flange is positioned in abutment with said seal edge of said base mounting flange and said tongue of said base mounting flange is seated snugly in the groove of said cup mounting flange.

9. The dispensing capsule of claim 1, wherein said diaphragm button is adapted to lock in said ingredient dispensing position after being pushed, holding said stake into said opened frangible membrane to maintain the opening such that the ingredient is discharged by flowing from said cavity through the opening in said frangible membrane and into the receiving container.

10. The dispensing capsule of claim 7, wherein an exterior peripheral surface of said cup mounting flange comprises ribbing.

11. The dispensing capsule of claim 7, wherein an exterior peripheral surface of said base mounting flange comprises ribbing.

12. The dispensing capsule of claim 7, wherein said dispensing capsule further comprises a drop band along the bottom edge of said base mounting flange that functions as a tamper evident seal.

13. The dispensing capsule of claim 1, wherein said diaphragm creates a flexible cavity volume such that an excessive pressure in said sealed cavity is relieved.

14. The dispensing capsule of claim 1, wherein said stake comprises a plurality of longitudinally disposed stress concentrating ribs which together define a diametric reach that is substantially constant throughout the entire stake but reduced at the opposing end of the diaphragm to a reduced diameter portion, wherein said stress concentrating ribs concentrate an axially transmitted force and direct it to said frangible membrane of said base plate via said reduced diameter portion.

15. The dispensing capsule of claim 14, wherein said stake is integrally formed with said diaphragm as a single injection molded unit.

16. The dispensing capsule of claim 14, wherein said stake further comprising a securing portion having increased diametric reach adjacent said diaphragm such that when said cup is inverted for filling operations, said securing portion causes said stake to be self standing and when an opening is fully formed in said frangible membrane, said securing portion prevents said stake from passing through the opening, thereby preventing a choking hazard from being deposited in the receiving container.

17. The dispensing capsule of claim 14, wherein said plurality of stress concentrating ribs are symmetrically disposed about the periphery of said stake.

18. The dispensing capsule of claim 14, wherein said plurality of stress concentrating ribs are asymmetrically disposed about the periphery of said stake.

19. The dispensing capsule of claim 1, wherein said at least one elongated tear line is disposed on the upper surface of said frangible membrane of said base plate inside said cavity of said dispensing capsule.

20. The dispensing capsule of claim 1, wherein said at least one elongated tear line is disposed on the lower surface of said frangible membrane of said base plate outside said cavity of said dispensing capsule.

21. The dispensing capsule of claim 1, wherein said at least one tear line comprises both a first groove on the upper surface and a second parallelly disposed corresponding groove on the lower surface of said frangible membrane of said base plate.

22. The dispensing capsule of claim 1, wherein said frangible membrane comprises a downward sloping surface such that a gravitational force urges the ingredient in the cavity to discharge through an opening in said frangible membrane and into the receiving container.

23. The dispensing capsule of claim 1, wherein said frangible membrane of the base plate comprises a door style frangible membrane.

24. The dispensing capsule of claim 1, wherein said cylindrical shaped side wall has sufficient transparency for preloaded contents to be visible to a user.

25. The dispensing capsule of claim 4, wherein said receiving container is a water bottle having a 38 millimeter mouth opening.

26. The dispensing capsule of claim 1, wherein said frangible membrane is capable of withstanding a differential gauge pressure of greater than 14 psi (9.653 e+004 newtons/square meter).

27. The dispensing capsule of claim 1, wherein said base of said stake comprises a cone shaped surface having a cone base that is concentrically disposed on said base of said stake such that when said diaphragm button is depressed, materials coming in contacting engagement with the cone shaped surface are pushed sideways, away from said stake, thereby facilitating movement of said stake downwardly toward said frangible membrane.

* * * * *